US010884380B2

(12) United States Patent
Hancock

(10) Patent No.: US 10,884,380 B2
(45) **Date of Patent: *Jan. 5, 2021**

(54) WRIST-WORN, TOOL AND ROUTINE ACTIVITY AIDING DEVICE

(71) Applicant: Patrick Andrew Hancock, Rosedale, MD (US)

(72) Inventor: Patrick Andrew Hancock, Rosedale, MD (US)

( * ) Notice: Subject to any disclaimer, the term of this patent is extended or adjusted under 35 U.S.C. 154(b) by 298 days.

This patent is subject to a terminal disclaimer.

(21) Appl. No.: 15/570,063

(22) PCT Filed: Apr. 28, 2016

(86) PCT No.: PCT/US2016/029830

§ 371 (c)(1),
(2) Date: Oct. 27, 2017

(87) PCT Pub. No.: WO2016/176478

PCT Pub. Date: Nov. 3, 2016

(65) Prior Publication Data

US 2018/0113421 A1 Apr. 26, 2018

Related U.S. Application Data

(63) Continuation of application No. 14/698,991, filed on Apr. 29, 2015, now Pat. No. 9,304,496.

(51) Int. Cl.
*G04B 37/12* (2006.01)
*B25F 1/04* (2006.01)
(Continued)

(52) U.S. Cl.
CPC ..... *G04B 37/12* (2013.01); *B25F 1/00* (2013.01); *B25F 1/003* (2013.01); *B25F 1/04* (2013.01); *G04B 47/00* (2013.01)

(58) Field of Classification Search
CPC .. B25F 1/04; B25F 1/1003; B25F 1/00; B25F 1/003; G04B 37/12; G04B 47/00; G04B 37/00; G04B 47/06; G04B 47/065
(Continued)

(56) References Cited

U.S. PATENT DOCUMENTS 1,404,536 A * 1/1922 Maculskiys ..... G04B 37/12 368/279
4,175,333 A * 11/1979 Kramer ..... G01C 17/10 33/344

(Continued)

OTHER PUBLICATIONS

Article entitled "1970 Safari Knife Watch" on the website The Watchismo Times at http://watchismo.blogspot.com/2007/03/1970-sicura-safari-knife-watch.html, posted in Mar. 2007.

(Continued)

*Primary Examiner* — Monica S Carter
*Assistant Examiner* — Marcel T Dion
(74) *Attorney, Agent, or Firm* — Larry J. Guffey, Esq.; Oliver & Grimsley, LLC

(57) ABSTRACT

A wrist-worn, tool and routine activity aiding device comprising, a wristband housing having a front that includes a bottom surface, an outer edge and a sidewall that extends upwards from said bottom surface outer edge, said sidewall having an inner surface, and a defined cavity boundary, a body having a boundary edge and top and bottom surfaces, a means for aiding the wearer in a routine activity of the wearer and that is attached to the body, a tubular member, a flange. The tubular member of the device is mounted to the body boundary edge, wherein the flange interacts with the wristband housing to lock and unlock the tubular member to the housing. Tool members have a configuration to be moved from a stored position to extended position for use, and wherein the tool members in a stored position are
(Continued)

located and stored completely within the boundaries of the cavity.

20 Claims, 33 Drawing Sheets

(51) Int. Cl.
*B25F 1/00* (2006.01)
*G04B 47/00* (2006.01)

(58) Field of Classification Search
USPC ..... 81/52; 7/118, 128
See application file for complete search history.

(56) References Cited

U.S. PATENT DOCUMENTS 4,888,869 A * 12/1989 Leatherman ..... B25F 1/003 30/161
5,065,373 A * 11/1991 Alcantara Maia ... G04B 37/127 368/10
5,160,134 A 11/1992 McDonald
5,838,639 A 11/1998 Hwang
6,006,385 A * 12/1999 Kershaw ..... B25F 1/04 7/128
6,079,872 A * 6/2000 Besson ..... G04B 37/127 368/10
6,094,403 A * 7/2000 Tran ..... G04B 47/00 368/10
6,098,497 A 8/2000 Larose
6,781,921 B2 8/2004 Markart
7,447,118 B1 11/2008 Matos
9,304,496 B1 * 4/2016 Hancock ..... B25F 1/04
2004/0016058 A1 * 1/2004 Gardiner ..... B25F 1/04 7/119
2004/0233786 A1 * 11/2004 Ting ..... G04B 47/00 368/2
2013/0020359 A1 1/2013 Green
2014/0196218 A1 * 7/2014 Frazer ..... B25F 1/04 7/118
2017/0351224 A1 * 12/2017 Reece ..... G04G 13/021

OTHER PUBLICATIONS

Item entitled "Multi Function Survival Kit w/Carabiner" on the website http://www.promo-wholesale.com/china/Kits-Survival/8/Multi-Function-Survival-Kit-W-Carabiner-114528.htm, printed on Mar. 11, 2015.
Item entitled "Leatherman Tread Watch with Tool Bracelet" on the website http://www.ablogtowatch.com/leatherman-tread-watch-tool-bracelet/, posted on Jan. 26, 2015.

* cited by examiner

WRIST-WORN, TOOL AND ROUTINE ACTIVITY AIDING DEVICE

CROSS-REFERENCE TO RELATED APPLICATION

This application is the United States National Phase entry of and claims the priority and benefits to PCT International Application No. PCT/US16/29830, filed on Apr. 28, 2016, and which is entitled "MULTI-PURPOSE TOOL WATCH HOUSING MULTIPLE TOOL MEMBERS TO BE MOVED FROM A STORED AND EXTENDED POSITION FOR USE", now pending, and is a continuation of and claims the priority and benefits of U.S. Regular patent application Ser. No. 14/698,991 filed Apr. 29, 2015 by the present inventor and for which U.S. Pat. No. 9,304,496 issued on Apr. 5, 2016 and which is entitled "MULTI-PURPOSE TOOL WATCH HOUSING MULTIPLE TOOL MEMBERS TO BE MOVED FROM A STORED AND EXTENDED POSITION FOR USE." The teachings of this application and patent are incorporated herein by reference to provide claimed priority benefits and continuity of disclosure to the extent that they do not conflict with the teaching herein and provide continuity of disclosure.

BACKGROUND OF THE INVENTION

1. Field of the Invention

The present invention relates generally to an integrated combination of a wristwatch with multi-purpose tool members to be moved from a stored position to an extended position for use. The wristwatch includes a watch for identifying time or featuring a routine activity of the wearer, and several multi-purpose tools that may include but are not limited to any select combination of the following items: a knife, a pair of scissors, a variety of screwdrivers, and a bottle opener, among other items. The integrated combination of a wristwatch with multi-purpose tool members thereby allows an individual to carry multiple tool members on the individual's person for everyday use, if desired, in a convenient, simple, clean, safe, inconspicuous, and compact storage manner.

2. Description of the Related Art

The present invention is particularly applicable to the multi-purpose folding tool industry, and to one who typically wears a wristwatch or also carries a multi-purpose folding tool, and will be described further with particular reference thereto.

The continuing concern among those in the multi-purpose folding tool industry and among consumers who wear wristwatches and carry multi-purpose folding tools is that a conventional wristwatch only provides utility as a timepiece or ornamental bracelet and a multi-purpose folding tool is a heavily weighted and bulky accessory of a multitude of sizes and configurations. In addition, a multi-purpose tool is often carried separate and apart from an individual's physical person, such as in a carry bag or a pocket of an article of clothing, or the tool may also be placed as an attachment on the individual's belt buckle or strap. Thus, there is ever growing concern to look for an invention that incorporates a conventional wristwatch and multi-tool member survival kit in a compact and convenient form such that an individual may carry a compact survival kit as a worn wristwatch for everyday use, select activities, or unexpected tasks.

A quick survey of the prior art in this area reveals that it is replete with myriad and diverse wrist housings for tools and multi-purpose folding tools. The folding tools allow a user to carry several tools in a housed manner. See, for example, U.S. Pat. Nos. 7,447,118; 6,781,921; 5,160,134; 5,838,639; 6,098,497; and U.S. application Ser. No. 13/357,673.

Various types of watches or foldable tools are traditionally available in a variety of shapes, sizes, and configurations. It is known that watches typically have a dial or face for displaying time or another routine activity of the wearer, and a housing having a cavity or area formed behind the dial or face in order to house the mechanisms of the watch. Many previously available hand tools provide for use of a single hand to drive tool bits of several different sizes and configurations. Previously available survival tool kits or tool bit holders with accompanying bits have required more space to be held or carried by the individual, and so it is desired to utilize tool kits in a more compact folding tool. Most, if not all, of these folding tools are limited in their size and shape and do not provide for a clean, convenient, safe, inconspicuous, or compact storage of multi-member tools on the body of the individual carrying the tool.

In some instances, certain watch cases contain a separate compartment to hold or conceal objects such as money, tokens, reflective surfaces, scissors, pocket knives, and compasses, which are traditionally carried separately by an individual. As such, a wide variety of dimensions of compartments and devices have developed over the years to provide a solution that allows other objects to be carried together with a conventional watch. These traditional multi-purpose devices typically include single function or single purpose objects or, in any event, a very limited number thereof. Therefore, a conventional wristwatch does not have the capacity or functionality to handle more than a single or very limited number of functions or purposed tools.

None of these solutions have addressed or resolved the problems faced by an individual with an affinity for the outdoors. An outdoors person, who may participate in fishing, hunting, hiking, and the like, would typically have a need for a contained housing, storing compact or pocket folding multi-purpose tools. Such tools are often separate and apart from any other gear that the individual may have or may be wearing on the individual's body such as the individual's conventional wristwatch that the majority of individuals wear on a regular basis. Because tool members are a separately carried item, the individual is required to remember to carry along multi-member tools or a pocket folding survival kit in addition to the multitude of other items that may be needed and required on a trip, outing, or activity.

Remembering to carry the various multi-member tools or pocket folding survival kit for an outing can be quite cumbersome and also opens up the possibility that a vital survival tool for the outing may be forgotten, misplaced, or become separated from the individual while the outing is underway.

The goal of any pocket folding tool member is to promote the convenience of a multi-tool survival kit in a clean, convenient, safe, inconspicuous, compact, and aesthetically pleasing configuration that may be carried and used by an individual during the course of the individual's normal activities. Moreover, a further goal of these products is to facilitate the functionality of survival tool kits and tool members having movable configurations positioned in stored and extended positions for tool use while an individual is engaged in activities experienced in the regular course of daily life, outdoor activities, and other events.

Conventional folding tools and survival kits suffer from a number of drawbacks in addressing the problem of convenient storage, wearing, carrying and handling of an effect on an individual's body in a sizable and compact fashion. One such drawback is that conventional survival kits and folding tools generally contain a plurality of tool members, thus making the entirety of the folding tools and survival kit both bulky and cumbersome. Therefore, in such a fashion, the individual would generally pick up and carry this survival tool or kit only to take it along on the desired outdoor activity, and the individual would not carry the item for everyday living and use if desired. The individual would keep the survival tools in a separate bag or pocket compartment, as these items are not regularly worn or carried on the body of the individual. Thus, the bulky and cumbersome size of the tools or kit would prevent the outdoors person from keeping the tool or kit on the individual's person at all times and decreasing the convenience of having a tool for unexpected tasks, events in everyday living, or in the event that a conventional tool kit becomes separated from the individual.

Therefore, the use of conventional, multi-tool member folding tools is not conducive for situations requiring coverage for extended periods of time or if the outdoors person is limited in the number of contents being carried or handled by the individual. Thus, these traditional folding tools and survival kits do not alleviate the problems typically encountered with ordinary use of these items. Despite the existence of many types of watches, foldable tools, and survival kits, individuals continue to experience inconvenience in remembering, carrying and transporting multi-member survival tools and kits.

Accordingly, a need exists for a new and improved multi-purpose tool watch having multiple tool members that may be moved from a stored position to an extended position for use. In addition, a need also exists for a multi-purpose tool watch that provides compact, convenient, clean, safe, inconspicuous, and easy storage in terms of allowing an individual to comfortably wear the watch on the individual's wrist and conveniently being able to access and use multiple tools upon necessity. It is a general object and desire of the present invention to provide such a multi-purpose tool watch having multiple tools and configurations so that the tools are stored and then can be extended for use. It is also the object of the present invention to enable multi-member tools to be easily remembered, carried, transported, and so that the tools remain attached to an individual's person while on an outdoor outing, during a select activity, encountering an unexpected task, or in everyday living. Such an apparatus provides versatility and addresses the shortcomings discussed earlier, and thus is highly desirable.

More specifically, there exists a need to combine such tools with another item that is regularly worn and easily transported on the body of the individual, not a tool that is carried separate and apart from the individual's person. Even further, there is a need for the arrangement of the apparatus to enable ease of use, convenience to carry, and flexibility to the individual. Further still, there is a need to provide multi-member tools in an aesthetically pleasing packaging for the individual end user. Such a packaging should be inconspicuous in appearance and require minimal effort and thought for use and transport by the individual end user. In addition, the object of the present invention is also to include previously available tool features but be able to provide them in a safer, and more comfortable manner, thereby providing more versatile ability of the tool members than previously available tools of comparable sizes.

SUMMARY OF THE INVENTION

Recognizing the need for the development of new and improved methods and products for watches integrated with multi-purpose folding tool members, the present invention is generally directed to the needs set forth above and overcoming the problems with and the disadvantages exhibited by traditional watches and folding tool members and survival kits.

The present invention relates to a wrist-worn, tool and routine activity aiding device for use by a wearer, said device comprising, (a) a wristband housing having a front that includes a bottom surface, an outer edge and a sidewall that extends upwards from the bottom surface outer edge, the sidewall having an inner surface, and wherein said bottom surface and sidewall inner surface define the boundaries of a cavity on said front of said wristband housing, (b) a watch body having a boundary edge and top and bottom body surfaces, (c) a means for aiding said wearer in a routine activity of said wearer and that is attached to said smart body, (d) a tubular member having inner and outer surfaces, and top and bottom ends, (e) a flange, which extends radially outward from an end of the tubular member, the flange having a top and bottom flange surface and a flange outer edge, (f) wherein the tubular member inner surface having a configuration adapted to allow the tubular member inner surface to be mounted proximate to the watch body boundary edge, (g) wherein the flange having a configuration adapted to allow the flange outer edge to interact with the sidewall inner surface of the wristband housing so as to intermittently lock and unlock the tubular member and flange to the wristband housing when an end of the tubular member is adjacent the wristband housing bottom surface, (h) a plurality of tool members, each having a configuration that is adapted to allow the tool member to be moved from a stored to an extended position for use, and (i) wherein the tool member configurations further adapted to allow the stored positions of each of the tool members to be located proximate said tubular member outer surface and beneath said flange bottom surface in a manner so as to allow said tubular member with said plurality of tool members in said stored positions to be located and stored completely within the boundaries of said cavity.

In other possible embodiments of the present invention: (j) a plurality of springs, each of which has a configuration adapted to allow the spring to wrap around the outer surface of the tubular member and to provide a resistive force that must be overcome by a multi-purpose tool watch user in moving each of the tool members from a stored to an extended position and vice versa, (k) a plurality of pivot mounting posts, each of which is attached to the flange and has a configuration adapted to allow each of the tool members to be pivotally mounted so as to rotate in a plane substantially parallel to the flange when moving from a stored to an extended position and vice versa, (l) means for preventing unintentional rotation of said plurality of tools, and (m) means for maintaining tool members positioned in said extended position for use.

In addition, the present invention can take the form of a method of fabricating a wrist-worn, tool and routine activity aiding device for use by a wearer, said device comprising the steps of: (a) a wristband housing having a front that includes a bottom surface, an outer edge and a sidewall that extends upwards from the bottom surface outer edge, the sidewall having an inner surface, and wherein said bottom surface and sidewall inner surface define the boundaries of a cavity on said front of said wristband housing, (b) a watch body having a boundary edge and top and bottom body surfaces, (c) a means for aiding said wearer in a routine activity of said wearer and that is attached to said smart body, (d) a tubular member having inner and outer surfaces, and top and bottom ends, (e) a flange, which extends radially outward from an end of the tubular member, the flange having a top and bottom flange surface and a flange outer edge, (f) wherein the tubular member inner surface having a configuration adapted to allow the tubular member inner surface to be mounted proximate to the watch body boundary edge, (g) wherein the flange having a configuration adapted to allow the flange outer edge to interact with the sidewall inner surface of the wristband housing so as to intermittently lock and unlock the tubular member and flange to the wristband housing when an end of the tubular member is adjacent the wristband housing bottom surface, (h) a plurality of tool members, each having a configuration that is adapted to allow the tool member to be moved from a stored to an extended position for use, and (i) wherein the tool member configurations further adapted to allow the stored positions of each of the tool members to be located proximate said tubular member outer surface and beneath said flange bottom surface in a manner so as to allow said tubular member with said plurality of tool members in said stored positions to be located and stored completely within the boundaries of said cavity.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
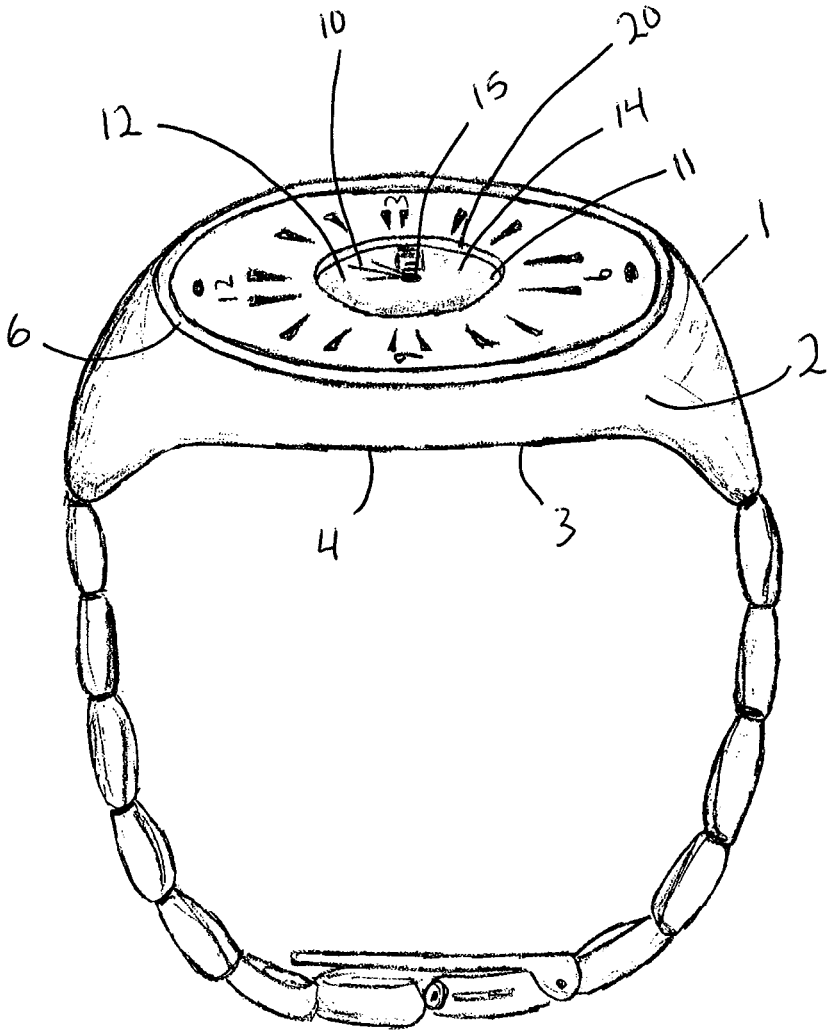
FIG. 1 is a perspective, elevational view that illustrates a preferred embodiment of the present invention, the multi-purpose tool watch to be worn on a wrist of an individual.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. For lexicon purposes, the terminology "user", "wearer", "individual", or "end user" are used interchangeably. In addition, references to a singular or plural element are used interchangeably and should not be regarded as limiting to the present invention. For example, use of the phrase and term "flange or flanges 30", "plurality" of springs 60 and posts 70 and the term "springs 60" and "posts 70" are used interchangeably and may refer to both a singular and plurality of embodiment. Thus, these terms may refer to any embodiment for the intended purpose and should not be interpreted as limiting the claims. In addition, the terms "watch" or "wristwatch" refer to a conventional watch, digital watch, fit watch, smart watch, or any other type of similar watch-type embodiment. Meanwhile, the terms "watch body" or "smart body" or "central body" are used interchangeably and refer to a type of casing to which various aids (e.g., watch, phone) are attached that are each capable of aiding a device wearer in some routine activity (e.g., telling the time, placing a phone call).

The present invention 1 is directed to an apparatus that provides an ordinary looking watch and includes a concealed, easily accessible, and compact set of multi-purpose tool members. The tool members provide elements that would be useful and critical to the survival of an individual in everyday living and outdoor activities. The tool members may include: a knife, screwdrivers (such as, for example, a Phillips-head screwdriver and flat-head screwdriver), scissors, and a bottle opener, among other items, such as, for example, a nail file, tweezers, wire strippers, and can opener. The tool members are stored in the multi-purpose watch 1 and the tools may be opened and extended for use when needed or desired. The tool members are securely held in the multi-purpose watch 1 when the tool members are in a stored position and not in use. This positioning of the tool members allows for convenient, clean, safe, inconspicuous, compact carrying and storage of the multi-purpose tools and attachment to a wristband housing that is connected to the wrist of the individual. This fashion of carrying the multi-purpose tool watch is similar to how an individual wears a conventional wristwatch.

Referring to FIG. 1, there is illustrated a preferred embodiment of the present invention 1 in the form of a multi-purpose tool watch 1. Typically, in everyday living or during outdoor activities, the user will wear the multi-purpose tool watch 1 on the individual's wrist. The most common way to use the multi-purpose tool watch 1 is for the individual to remove the watch tool kit 203050 from the wristband housing 2 that continues to be worn on the wrist of the individual. See also FIGS. 4A, 13A, 23 and 24. The individual may also remove the entire multi-purpose tool watch 1, including the wristband housing 2, from his or her wrist first, and next then remove the tool kit 203050 from the wristband housing 2. See FIGS. 1-4.

Figure 2:
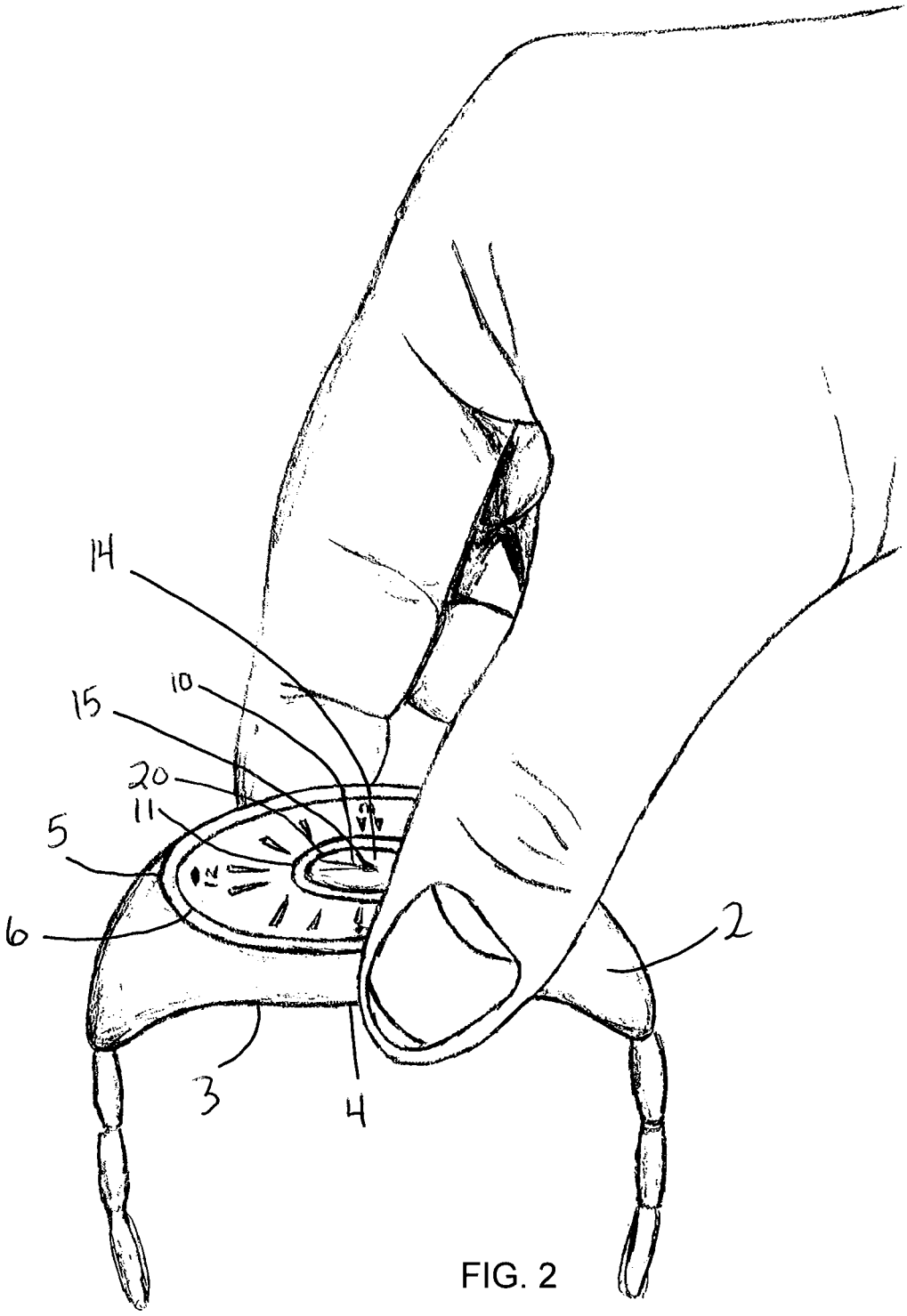
FIG. 2 is a perspective, elevational view that illustrates a preferred embodiment of the present invention, the multi-purpose tool watch being shown apart from the wrist of an individual.
Figure 3:
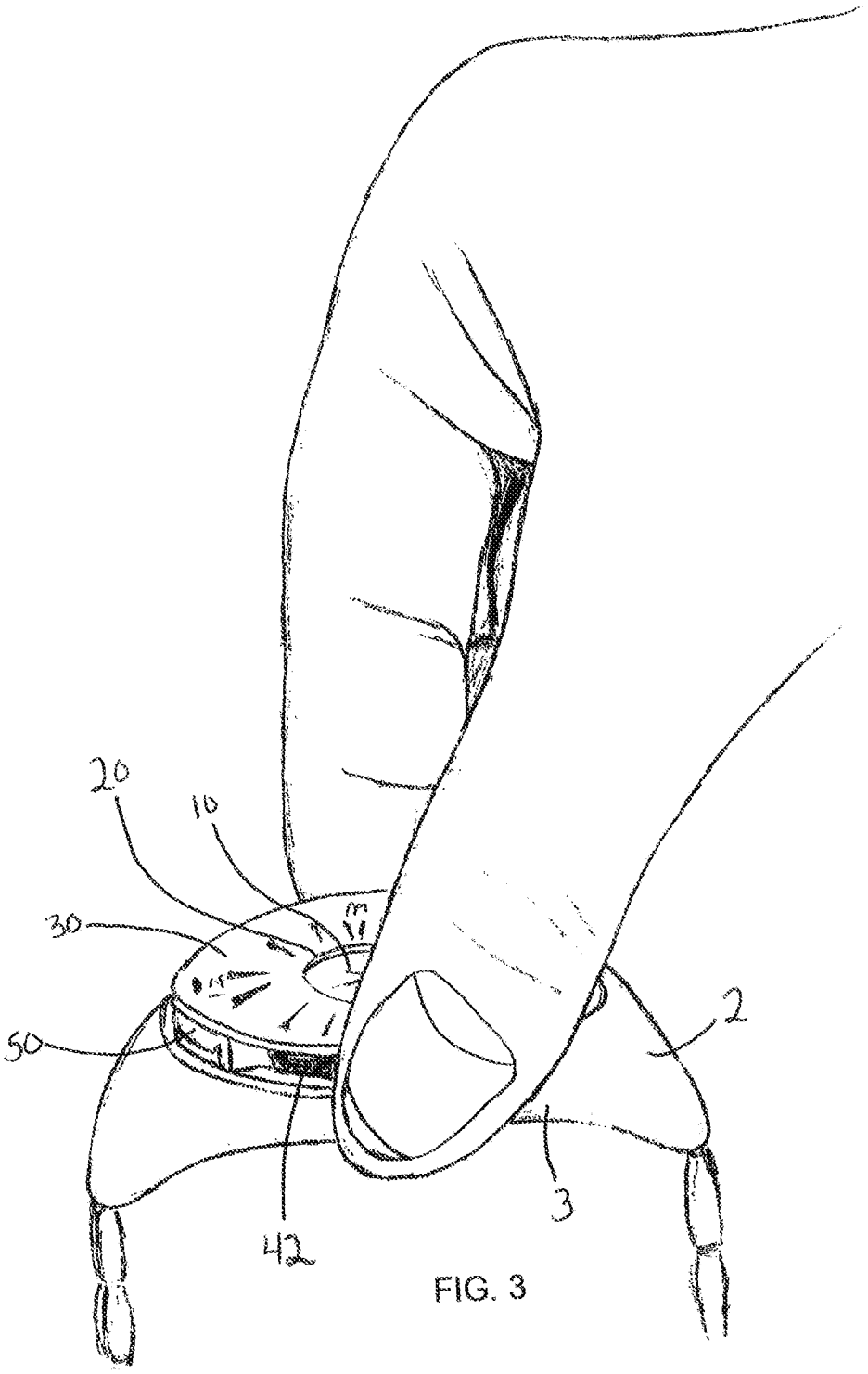
FIG. 3 is a perspective, elevational view that illustrates a preferred embodiment of the present invention, the multi-purpose tool watch being shown apart from the wrist of an individual and the individual beginning to remove the tool kit, including the watch body, tubular member, flange, and tools from the wristband housing.

FIGS. 1-3 show the multi-purpose tool watch 1 with the tool members 50 in a closed and stored position and configuration. The multi-purpose tool watch 1 comprises parts or elements that include: a wristband housing 2, a watch body 10, a tubular member 20, a flange 30, pair, or plurality of flanges 30. The tool members 50 are stored in a closed position and located, when said watch body 10 bottom body surface 13 is adjacent said wristband housing 2 bottom surface 3, between said tubular member 20 outer surface 22 and said sidewall 6 of the wristband housing 2. Thus, the tool member 50 configurations further adapted to allow the stored positions of each of the tool members 50 to be located proximate said tubular member 20 outer surface and beneath said flange 30 bottom surface in a manner so as to allow the tubular member 20 to be stored completely within the boundaries of the cavity 40.

For illustrative purposes, this location of the tools in a stored position may be interchangeably referred to herein as the donut-shaped area 42, area 42, or cavity 42. Similarly, the phraseology and terminology "donut-shaped area" is for ease of description for an embodiment of the present invention. This phrase should not be regarded as limiting, as many shapes could depict the form of the area and a general area is what is intended for the scope of this invention. In addition, the phraseology and terminology "flange" is for ease of reference and may refer to the singular, pair, or plurality of flanges 30, and should not be interpreted as limiting.

A flange 30 extends radially outward from an end of the tubular member 20. The tubular member 20 outer surface 22 and the sidewall 6 of the wristband housing 2 create a donut-shaped area 42 where a plurality of tool members 50 may be housed. In one embodiment, the wristband housing 2 bottom surface 3 and sidewall 6 inner surface 7 define the boundaries of a cavity 40 on said front of said wristband housing 2.

In one embodiment, a pair, or plurality of flanges 30, are spaced apart and situated atop each other in a substantially parallel configuration. The tubular member 20 is situated within the pair of flanges 30 and has a configuration that is substantially perpendicular to the pair of flanges 30. In addition, the tool members 50 have a configuration that is adapted to allow them to move from a stored position to an extended position for use. The tool member 50 configurations are further adapted to allow the stored positions of each of said tool members to be located proximate said tubular member 20 outer surface 22 and beneath said flange 30 bottom surface 32 in a manner so as to allow said tubular member 20 with said plurality of tool members 50 in said stored positions to be located and stored completely within the boundaries of said cavity 42. In one embodiment, the tool member 50 configurations are further adapted to allow the stored positions of each of said tool members to be located 40, when said watch body 10 bottom surface body 13 is adjacent said wristband housing 2 bottom surface 3, between said tubular member 20 outer surface 22 and said sidewall 6 of the wristband housing 2. Thus, the tool member 50 configurations further adapted to allow the stored positions of each of the tool members 50 to be located proximate said tubular member 20 outer surface and beneath said flange 30 bottom surface 32 in a manner so as to allow the tubular member 20 with the plurality of tool members 50 in the stored positions to be located and stored completely within the boundaries of the cavity 42. See FIGS. 1 and 4.

In another embodiment, the tool members 50, when stored are positioned to fit in the area 40 located in their closest proximity to the tubular member 20 outer surface 22.

The combination of the tubular member 20, flanges 30, area 42, and tool members 50, are referred to herein as the "tool kit", and this combination is identified with the numeral designation 203050 to indicate that the tool kit 203050 is a combination of several elements. Note, that in one possible embodiment, the tool kit 203050 also includes the watch body 10. However, for ease of reference, we will simply identify the tool kit as 203050.

The wristband housing 2 comprises a front that includes a bottom surface 3, an outer edge 5 and a sidewall 6 that extends upwards from the bottom surface outer edge 5, the sidewall 6 having an inner surface 7, and wherein said bottom surface and sidewall inner surface define the boundaries of a cavity 40 on the front of the wristband housing 2. See FIG. 10. In one embodiment, the wristband housing 2 comprises a front that includes a bottom surface 3, with a center point 4. In addition, in the present invention, the wristband housing 2 has a configuration to be secured to and worn on the wrist of an individual via means similar to the means of securing and wearing a conventional wristwatch. As these traditional securing means are well known in the art, they will not be discussed in detail herein.

The watch body 10 comprises a boundary edge 11, a top 12 body surface, and a bottom 13 body surface. In addition, the watch body 10 also comprises a means 18 for aiding the wearer in a routine activity of the wearer and that is attached to the watch body 10. Such routine activities include for example: something chosen from the group including the time of day; a location of said wearer (such as a Global Positioning System); an indication of the activity level or wellness of said wearer; an audio, visual, television, radio, electronic, or similar communication means to said wearer; an audio, visual, television, radio, electronic, or similar communication means to said secondary device (such as a computer, radio, or television), or no device at all. Note, the device may have wired or wireless capabilities. More details regarding such routine activities are detailed more herein. Note, these routine activities are not meant to be limiting, and it should be understood by one skilled in the art that routine activities may include any number of individual or combined activities in order to achieve the desired purpose of the present invention and without departing from the scope of the present invention. In addition, by way of further example, the routine activities include: a calculator, camera/video/sound/storage device, weather device, music storage, sleep/health/medical monitor (including but not limited to heart rate 19*b*, body temperature 19*c*), data storage device, internet/cloud/TV/radio connectivity device, smart watch, mapping/Global Positioning System (GPS)/compass, satellite receiver, phone/communication/email/texting/social media device, flashlight, alarm/notification/alert device, fitness/exercise monitor/device, diving device, altitude device, digital/analog watch/clock, date/calendar device, gaming device, language translation device, electronic key/entry device, vehicle start/entry device, firearm activation device, home automation device, thermometer, stopwatch, walkie-talkie set, laser pointer, computer mouse, remote garage door opener, small item storage compartment, or no device at all. Thus, in addition to the above-referenced items, the invention may have means of aiding said wearer in a routine activity of said wearer and that is attached to said smart body, or a combination of one or more routine activity items, or the body 10 may contain no routine activity aiding device at all. The plural routine activities shall be included in the reference term "routine activity". In one embodiment, the top surface 12 or bottom body surface 13 of the watch body 10 further comprises a watch face 14 that is configured to visually communicate at any instant the time of day or routine activity of the wearer.

In one embodiment, the watch body 10 bottom body surface 13 may be affixed to the wristband housing 2 bottom surface 3. In another embodiment, the watch body 10 bottom body surface 13 comprises a center point 15. In still yet another embodiment, this affixation to the wristband housing is such so that the wristband housing 2 center point 4 and the watch body 10 center point 15 both coincide. FIGS. 1-4. In another preferred embodiment, the present invention features the watch body 10 as it may be affixed to the wristband housing 2 via removable or permanent means in connection with the tubular body 20 or flanges 30. Another possible embodiment features the watch body 10 having a configuration that may be directly affixed to the wristband housing 2 bottom surface 3 via removable or permanent means.

The tubular member 20 has a further configuration adapted to allow the tubular member 20 to be mounted to or proximate the watch body 10 boundary edge 11. In addition, the flange 30 interacts with the sidewall 6 of the wristband housing 2 so as to intermittently lock and unlock the tubular member 20 and flange 30 to the wristband housing 2. Note, the phraseology and terminology "tubular member" is for ease of description for an embodiment of the present invention. This phrase should not be regarded as limiting as many shapes or forms depict the form of a substantially hollow member. In addition, the tubular member 20, which may be of any desired shape or form, is preferred in a substantially circular form. The tubular member 20 made of any suitable material such as, for example, metal, stainless steel, wood, polymer, molded material or the like material. FIGS. 1-4. These materials, like all of the materials listed herein, are listed as examples and should not be interpreted as being limiting to the materials used in making the invention. In one possible embodiment, the watch body 10 is permanently affixed to the tubular member 20. In another possible embodiment, the tubular member 20 has a configuration to fit around the watch body 10 and substantially enclose the sides of the watch body 10. See for example, FIG. 8A. In another possible embodiment, the tubular member 20 may partially close around the watch body 10. Yet, another possible embodiment, the tubular member 20 may be a solid form, or in yet another embodiment the watch body 10 may be an extension of the flange 30 or be positioned proximate a flange 30, such that the watch body 10 sits atop or proximate the top surface of the flange 30, or a bottom watch body surface may act as a flange. The watch body 10 may also be positioned on or proximate the outer facing surface of the flange 30.

In order to use the concealed tool members 50, the individual removes the tool kit 203050 from the wristband housing 2. See FIGS. 1 and 4. The wristband housing 2 may remain on the individual's wrist in the preferred fashion. Next, the individual selects the desired tool member 50 from the stored position inside the donut-shaped area 42 of the tool kit 203050. The individual then configures the selected tool member 50 into an extended position for use. FIG. 4A demonstrates the tool kit 203050 apart from the wristband housing 2 and displaying a variety of multi-purpose tool members 50, 50*a-e*, in an extended, or partially extended, position. Generally, the individual selects one tool member 50 for use at a time. However, depending on the configuration of the tool members 50, and the tool selected for use, additional tool members may also be extended at the same time.

The individual uses the tool kit 203050 as a handle to effectively use the selected tool member 50 and perform the desired task. See FIGS. 5-7. When the individual has completed the task, the individual may return the selected tool member 50 to the stored, closed position by placing the tool member 50 inside area of the tool kit 203050. The individual may then secure the tool kit 203050 to the wristband housing 2 located on the individual's wrist in one fashion, and, therefore, returning the tool kit 203050 to its original multi-purpose tool watch 1 form. Thus, the individual is permitted to wear the tool kit 203050 on the wristband housing 2 on the wrist of the individual for conventional use and for the convenience of wearing an inconspicuous and compact set of multi-purpose tools in a general wristwatch fashion.

Moreover, the wristband housing 2 may be made of any suitable material such as metal, stainless steel, wood, polymer, plastic, molded material or the like material in order to achieve the desired function for use and comfort and to support and secure the tool kit 203050, including tubular member 20, flange 30, and the tool members 50. FIGS. 1-4. These materials, like all of the materials listed herein, are listed as examples and should not be interpreted as being limiting to the materials used in making the invention.

The multi-purpose tool watch 1 also comprises a tubular member 20 that has an inner 21 surface, an outer 22 surface, and a top end 23 and a bottom 24 end, wherein the tubular member 20 inner surface 21 has a configuration adapted to allow the tubular member 20 inner surface 21 to be mounted proximate to the watch body 10 boundary edge 11.

In addition, the multi-purpose tool watch 1 also comprises a flange 30, which extends radially outward from an end of tubular member 20. The flange 30 also has a top flange surface 31 and a bottom flange surface 32 along with a flange outer edge 33. FIGS. 16-20A-E.

In one embodiment, the multi-purpose tool watch 1 comprises a flange 30 or pair or plurality of flanges 30, one of which extends radially outward from the top end 23 of the tubular member 20, and the other of which extends radially outward from the bottom end 24 of the tubular member 20. Each flange 30 also has a top flange surface 31 and a bottom flange surface 32 along with a flange outer edge 33. FIGS. 16-20A-E.

The invention further includes a donut-shaped area 42 where the tool members 50 are stored in a closed position and located, when said watch body 10 bottom body surface 13 is adjacent said wristband housing 2 bottom surface 3, between said tubular member 20 outer surface 22 and said sidewall 6 of the wristband housing 2. Thus, the tool member 50 configurations further adapted to allow the stored positions of each of the tool members 50 to be located proximate said tubular member 20 outer surface and beneath said flange 30 bottom surface in a manner so as to allow the tubular member 20 to be stored completely within the boundaries of the cavity 42.

The flange 30 that has a configuration adapted to allow the outer edge 33 of flange 30 to interact with the sidewall 6 inner surface 7 of the wristband housing 2 so as to intermittently lock and unlock the tubular member 20 and flange 30 to the wristband housing 2 when an end 23, 24 of the tubular member 20 is adjacent the wristband housing 2 bottom surface 3. See FIGS. 1-4. Thereby, the tool kit 203050 is secured to the wristband housing 2. The invention comprises embodiments where either end 23, 24 of the tubular member 20 may be mounted proximate or to the bottom surface of the wristband housing 2. Thus, in one embodiment, the body 10 bottom surface may be proximate the wristband housing bottom surface 3. Or, in another embodiment, the body 10 top surface may be proximate the wristband housing bottom surface 3. In still yet another embodiment, the body 10 or tool kit has the capability to be reversibly positioned in how it is seated in the wristband housing 2. In addition, the tubular member 20 may be mounted directly or indirectly to the wristband housing 2. In one embodiment, the tubular member 20 is mounted to the wristband housing 2 via the flange 30.

The present invention also includes a plurality of tool members 50, each having a configuration that is adapted to allow each tool member 50 to be moved from a stored position to an extended position for use. The tool member 50 configurations are further adapted to allow each tool member 50 in the stored position to be located proximate said tubular member 20 outer surface 22 and beneath said flange 30 bottom surface 32 in a manner so as to allow said tubular member 20 with said plurality of tool members in said stored positions to be located and stored completely within the boundaries of said cavity 42.

In another embodiment, the tool member 50 configurations are further adapted to allow each tool member 50 in the stored position to be located, when said watch body 10 bottom body surface 13 is adjacent said wristband housing 2 bottom surface 3, between said tubular member 20 outer surface 22 and said sidewall 6 of the wristband housing 2.

In a preferred embodiment, the tool kit 203050 comprises a plurality of springs 60, each of which has a configuration adapted to allow the spring 60 to wrap around the outer surface 22 of the tubular member 20. The springs 60 provide a resistive force that must be overcome the individual in moving one or more of said tool members 50 from a stored to an extended position and vice versa. See FIGS. 16-19A.

The present invention 1 further comprises means for preventing unintentional rotation of said plurality of tools. In one embodiment, the present invention includes a tool stop 80. See FIGS. 16-19A. The tool stop 80 provide a surface such that when a tool member 50 is extended from a stored position to an open position, the tool stop 80 limits the extension of the tool member 50 and dictates when the open position is fully reached. The tool stop 80 seeks to prevent over extension of a tool member 50, and restricts the unintentional rotation of a tool member 50, and thus provides a tool member 50 stopping function.

In another preferred embodiment, the present invention 1 further comprises a means for maintaining tool members in an extended position for use. One embodiment involves the tool stop 80 and spring 60 in combination with the tool member 50 so that the tool member 50 is maintained in the extended position. See FIGS. 19 and 19A.

Figure 4:
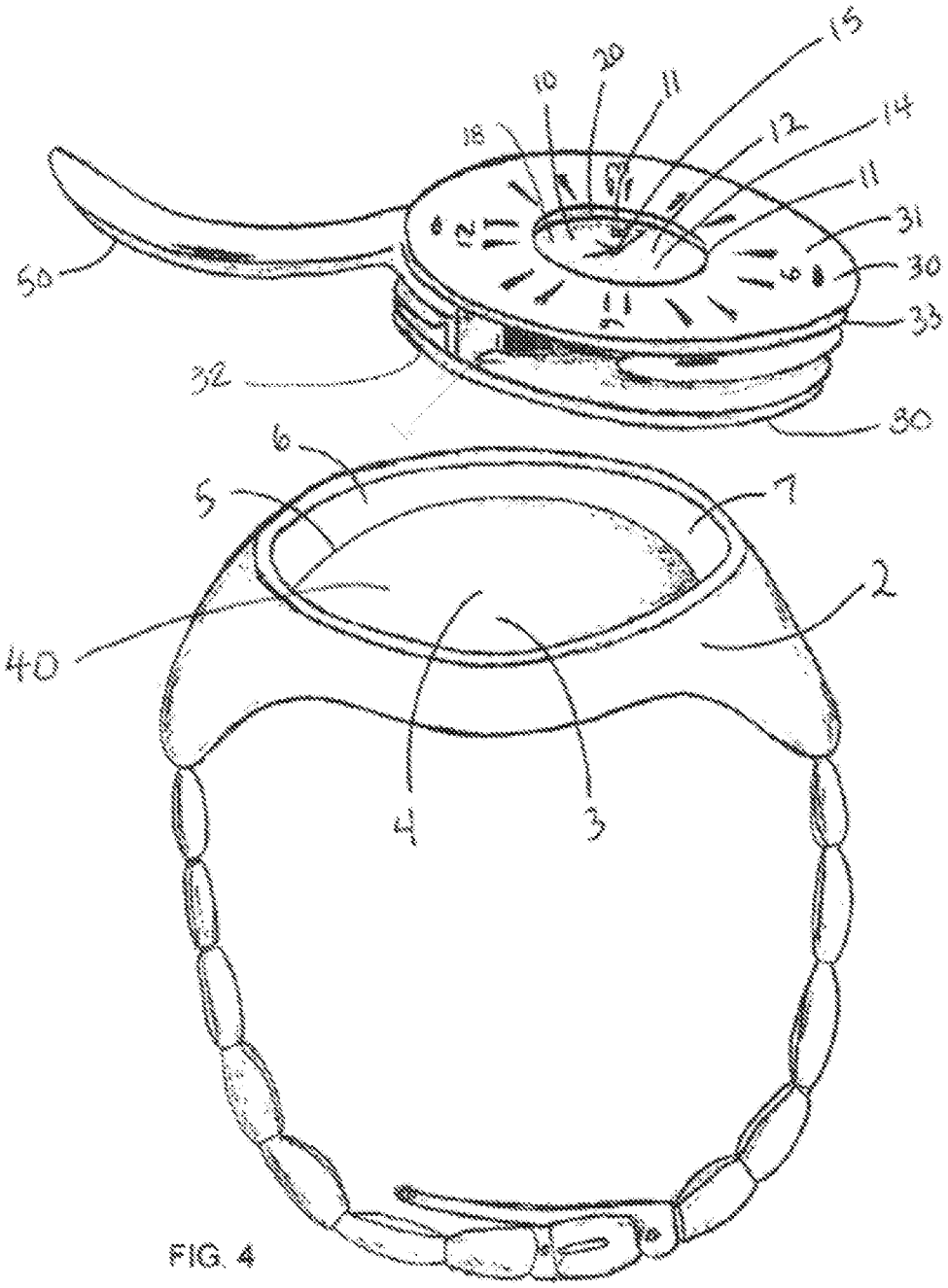
FIG. 4 is a perspective, elevational view that illustrates a preferred embodiment of the present invention, the multi-purpose tool watch being shown apart from the wristband housing and the individual having removed the tool kit and holding the tool kit with a tool member positioned and extended for use. The device also features a means for aiding said wearer in a routine activity of said wearer, and in this embodiment, by way of one example, the device features a watch to display time.
Figure 4A:
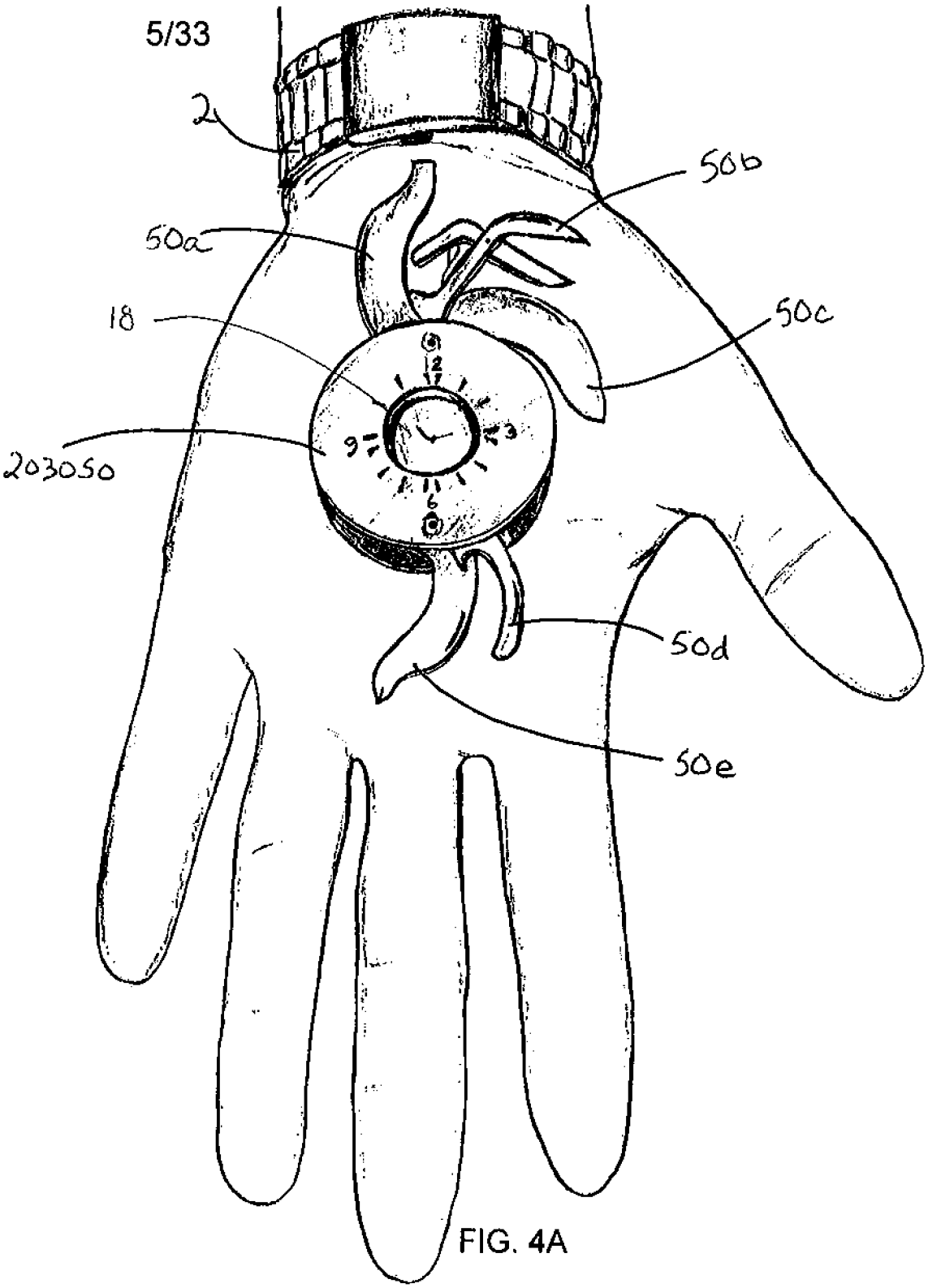
FIG. 4A is a perspective, elevational view that illustrates a preferred embodiment of the present invention, the multi-purpose tool watch being shown apart from the wrist of an individual and the individual having removed the tool kit, including the watch body, tubular member, flange, and tools from the wristband housing and tool members extended for use, including for example, a flat head screwdriver, scissors, knife, bottle opener, and Phillips head screw driver. This Figure also demonstrates one embodiment of a stand-alone tool kit used separately from the wristband housing, if so desired, while the wristband housing remains on the user's wrist. The device also features a means for aiding said wearer in a routine activity of said wearer, and in this embodiment, by way of one example, the device features a watch to display time.

FIGS. 2-4 show the multi-purpose tool watch 1 and an individual as he or she removes the tool kit 203050 from the stored location affixed to the wristband housing 2 that may remain attached to the individual's wrist. FIGS. 2-4 show a perspective, elevational view of the preferred embodiment of the present invention and further details that at least one flange 30 has a configuration adapted to allow the outer edge 33 of the flange 30 to interact with the inner surface 7 of the wristband housing 2 sidewall 6. In doing so, the outer edge 33 of the flange 30 and inner surface of the wristband housing 2 intermittently lock and unlock. In one embodiment, the tool kit 203050 intermittently locks and unlocks the tubular member 20 and flange 30 to the wristband housing 2 when an end 23, 24 of the tubular member 20 is adjacent to the wristband housing 2 bottom surface 3. It should be noted, that either end 23, 24 of the tubular member 20 may be adjacent to the wristband housing 2 bottom surface 3. In one embodiment, the tubular member 20 and flanges 30, or tool kit 203050, are affixed to the wristband housing 2 by means of threaded grooves, such that, in one embodiment, the flange 30 or tool kit 203050, screw into the wristband housing 2 in order to be secured to the wristband housing 2. Thus, a flange 30 may be locked and unlocked to the wristband housing 2. It should be understood that the tubular member 20 and flange 30, or tool kit 203050, could otherwise have a configuration to be affixed to the wristband housing 2 and the multi-tool watch 1 could be provided with any number of suitable connecting, coupling, or attachment means without departing from the scope of the present invention. For example, the tubular member 20 and flange 30, or tool kit 203050, may be affixed to the wristband housing 2 by a connecting means of the releasable type, such as with a clamp, latch, or snap attachment. Other means may include magnets, or an interconnecting or insert-type of attachment.

Moreover, in one embodiment, the tool kit 203050 is positioned in the wristband housing 2, such that the watch body 10 top body surface 12 or bottom body surface 13 may be affixed to the wristband housing 2 bottom surface 3. In addition, another embodiment, features the tool kit 203050 positioned in the wristband housing 2, such that the watch body 10 top body surface 12 or bottom body surface 13 having a center point 15 may be affixed to the wristband housing 2 bottom surface 2 so that the watch body 10 center point 15 coincides with the wristband housing center point 4. It should be noted, that while the tool kit 203050 is affixed to the wristband housing 2, the tool kit 203050 in another embodiment may also be used as a stand-alone tool kit as a compact, convenient, multi-tool kit, and carried as a separate personal item if so desired. The tool kit 203050 may also include a loop or attachment type feature to secure the stand-alone tool kit 203050 to an individual's belt loop or bag handle or clip.

FIG. 4 provides a perspective, elevational view of the multi-tool watch invention 1, in which the tool kit 203050 has been removed from the wristband housing 2. A selected tool member 50 has been moved from the stored position located in an area 42 between said tubular member 20 outer surface 22 and said sidewall 6 of the wristband housing 2, when said watch body 10 bottom body surface 13 is adjacent said wristband housing 2 bottom surface 3. In one embodiment, the stored positions are located proximate said tubular member 20 outer surface 22 and beneath said flange 30 bottom surface 32 in a manner so as to allow said tubular member 20 with said plurality of tool members in said stored positions to be located and stored completely within the boundaries of said cavity. The tool members 50 may be extended to a position for use. A plurality of tool members 50 exist, each having a configuration adapted to allow the respective tool member 50 to be moved from a stored position to an extended position for use.

Moreover, FIG. 4A shows the tool kit 203050 after it has been removed from the wristband housing 2. In this embodiment, the wristband housing 2 remains on the wrist of the individual user. The tool kit 203050 in one possible embodiment features tool members 50 including not limited to a flat head screwdriver 50*a*, scissors 50*b*, a knife 50*c*, a bottle opener 50*d*, and a Phillips-head screwdriver 50*e*. See FIGS. 4A, and 11-15. In should be noted, that possible embodiments include one tool member 50 or a plurality of tool members 50 in various combinations. Moreover, the order and positioning of the tool members 50 is not limited to the ordered positioning as shown. The tool members 50 featured are illustrative of one possible embodiment of the invention.

The tubular member 20 is shown in more detail in FIGS. 8A-8F. In this possible embodiment, the tubular member 20 is a substantially hollow, cylindrical form that partially surrounds or encircles the watch body 10 and provides for a semi-encasement of the watch body 10. In addition, the tubular member 20 also provides support to the flange 30 proximate the external boundary edge of the watch body 10. The tubular member 20 has an inner surface 21 and an outer surface 22, as well as, a top end 23 and bottom end 24. See also FIGS. 4, 16-20A-E. The tubular member 20 may be made of any suitable material, such as, for example, metal, aluminum, steel, wood, polymer, plastic, and molded material, or the like. These materials, like all of the materials listed herein, are listed as examples and should not be interpreted as being limiting to the materials used in making the invention.

FIGS. 4, 8, 8A-8F, provide more details of the construction of the tubular member 20 used in the present invention. The tubular member 20 inner surface 21 has a configuration adapted to allow the tubular member 20 inner surface 21 to be mounted proximate to the watch body 10 boundary edge 11. The preferred shape of the tubular member 20 is cylindrical, however, it should be understood by one skilled in the art that the tubular member 20 may be of any shape in order to achieve the desired purpose of the present invention and without departing from the scope of the present invention. In another embodiment, the tubular member 20 may be a permanent fixture affixed to the flange 30, or may be removably mounted.

In another possible embodiment, the tubular member 20 may also be fashioned having a configuration as being, or being in effect, the external walls of the watch body 10. For example, the tubular member 20 could be connected to the watch body 10 by a connecting means of the releasable type or of the permanent type without departing from the scope of the invention. The tubular member 20 could be easily adhered to adjoin the watch body 10 via a releasable mechanism, magnetized attachment or some other means of temporary affixing. In another possible embodiment, the tubular member 20 could be welded or affixed by other means or configured to be a continuous part or external wall of the watch body 10, and, thus, the tubular member 20 would be affixed to the watch body 10 by way of permanent embodiment. In one possible embodiment, the tubular member 20 serves to provide support for a plurality of springs 60. FIGS. 8F, and 16-20A-E.

In addition, FIGS. 4, 8, 8A, and 8B also demonstrate details showing a flange 30 or pair of flanges 30 where at least one flange 30 extends radially in the outward direction from the tubular member 20. The tubular member 20 outer surface 22 and the sidewall 6 of the wristband housing 2 form a donut-shaped area 42 where the tool members 50 may be stored when not in use. In one embodiment, the area may be donut-shaped and take on the form of the watch that is in a preferred circular, cylindrical shape. It should be understood that the donut-shaped area 40 may be of any area shape and will fall within the scope of the invention. Use of the term "donut-shaped" is not meant to be limiting. In addition, in one possible embodiment of the present invention, the flange 30 top surface flange 31 features the visual markings or numerals used to communicate to an individual the time of day. See FIGS. 1, 4A, 8, 23, and 24. In addition, FIGS. 4 and 4A, feature a device with means for aiding said wearer in a routine activity of said wearer, and in each embodiment in these figures, by way of example, the device features a watch to display time.

Figure 8:
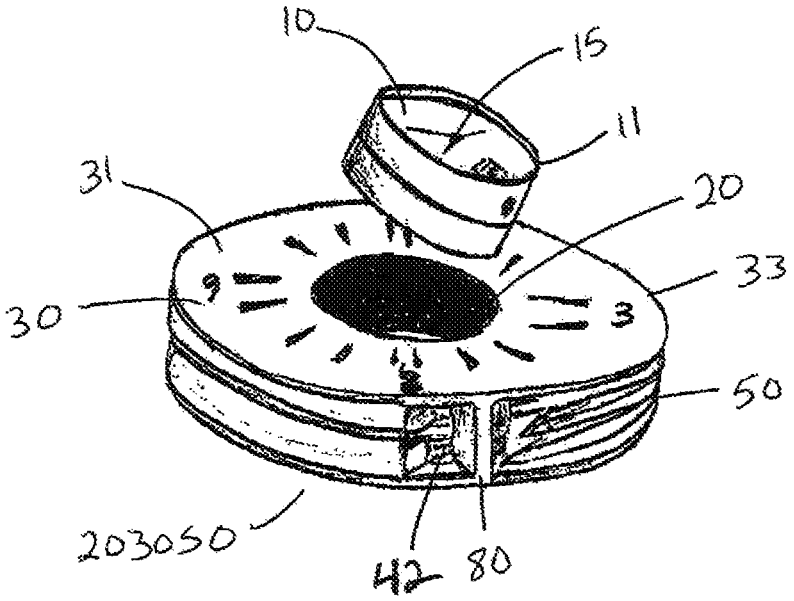
FIG. 8 is a perspective, elevational view that illustrates a preferred embodiment of the present invention, the multi-purpose tool kit with the watch body removed.
Figure 8A:
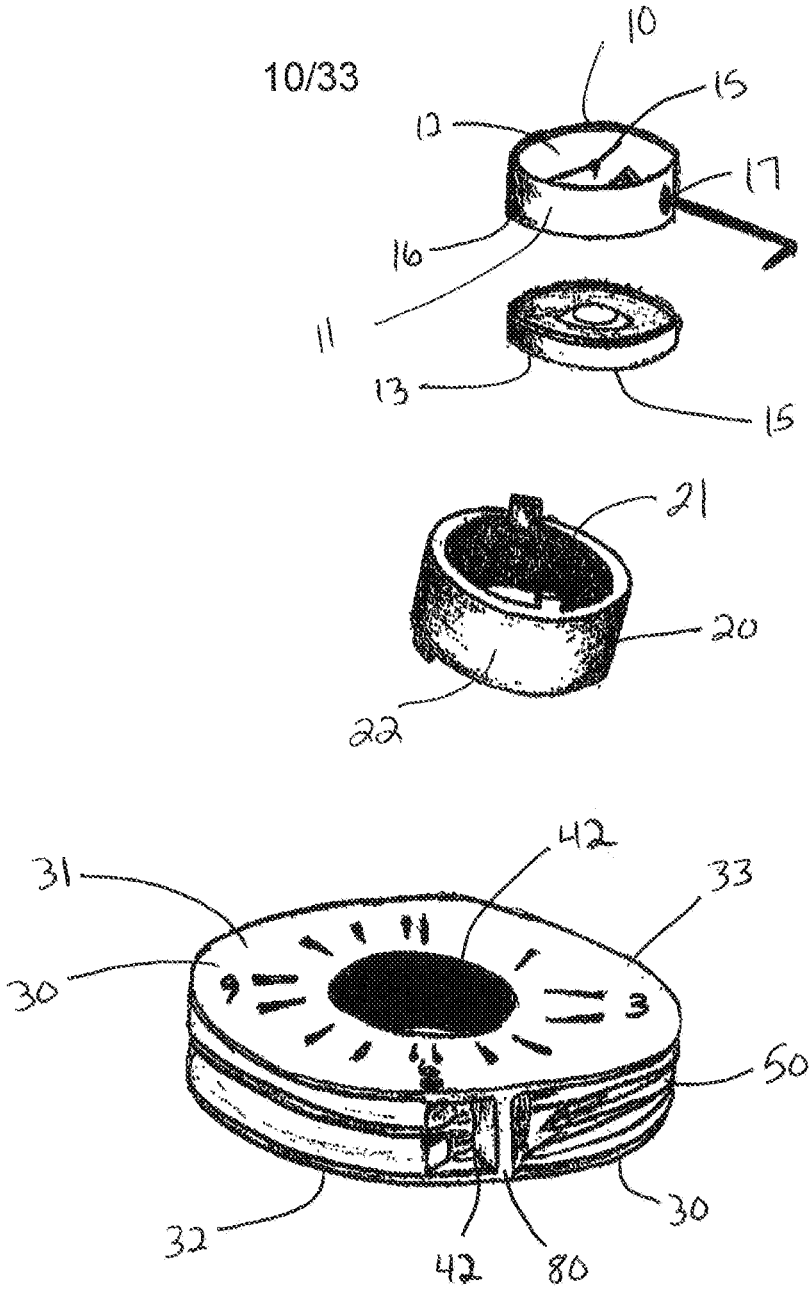
FIG. 8A is a perspective, elevational view that illustrates a preferred embodiment of the present invention, the multi-purpose tool kit with the tubular member and watch body removed.
Figure 8B:
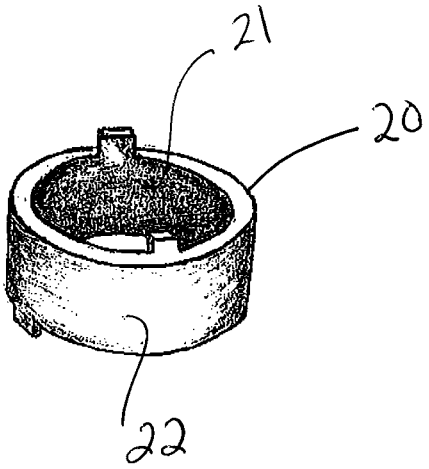
FIG. 8B is a perspective, side view and top view that illustrate a preferred embodiment of the tubular member of the present invention.
Figure 8C:
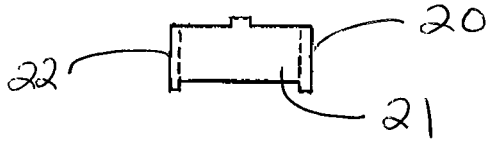
FIG. 8C is a perspective, side view that illustrates a preferred embodiment of the tubular member of the present invention.
Figure 8D:
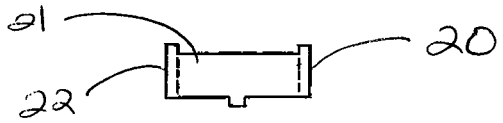
FIG. 8D is a perspective, side view that illustrates a preferred embodiment of the tubular member of the present invention.
Figure 8E:
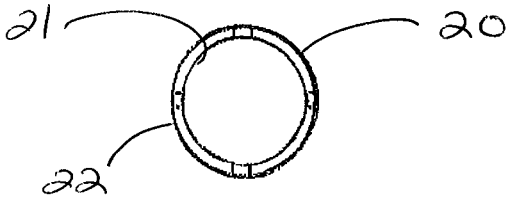
FIG. 8E is a perspective, top view that illustrates a preferred embodiment of the tubular member of the present invention.
Figure 8F:
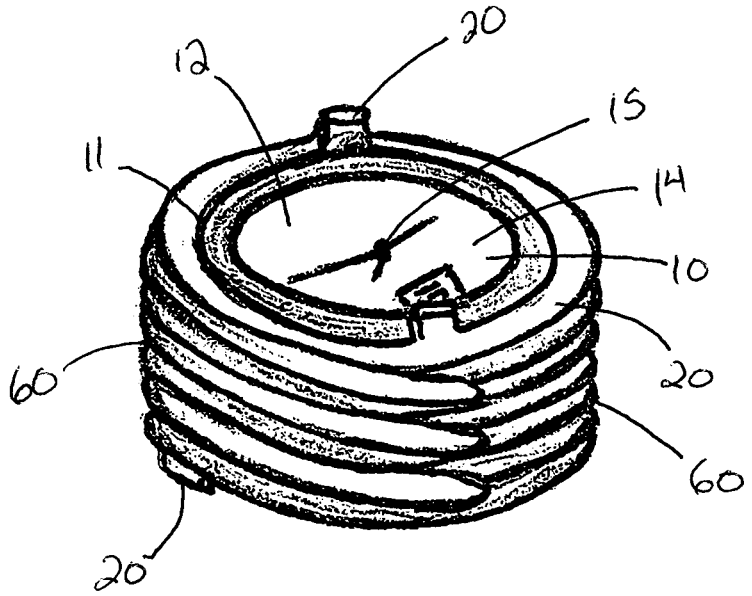
FIG. 8F is a perspective, top view that illustrates a preferred embodiment of the tubular member of the present invention with a plurality of springs, each of which has a configuration adapted to allow the spring to wrap around the outer surface of the tubular member.

FIG. 8 shows the multi-purpose tool watch 1 separate and apart from the wristband housing 2. In addition, FIG. 8 also shows one embodiment of the present invention where the watch body 10 is separate and apart from the tool kit 203050. The watch body 10 in another embodiment may comprise a plurality of parts, including a removable top and bottom portion. Another possible embodiment of the watch body 10 comprises a removable top body surface 12 and bottom body surface 13 as well. In yet another embodiment, the bottom portion of the watch body 10 may house a battery used to provide power to the watch. The location of the battery provides for easy removal and replacement via the bottom portion of the watch body 10 or removal of the watch body 10 bottom surface 13. In addition, the watch body 10, as removable from the multi-purpose tool watch 1, has means to allow for an individual to access the internal watch body 10 components. For example, a screw setting 16 or other means for attachment may be used to remove the bottom portion of the watch body 10, or provide access to the winding features 17 of the watch in order to set the proper time. The individual may view the time while wearing the watch in the wristband housing 2 as a conventional watch or while the individual is using the multi-purpose tool watch 1, or as a tool kit 203050, and desires to reference the time.

Continuing with FIG. 8, and also referencing FIGS. 11-20A-E, these figures provide more details of construction and configuration of the tool members 50 used in the present invention 1. The tool members 50 have configurations that are further adapted to allow the stored positions of each tool member 50 to be located substantially inside the donut-shaped area 42. The ability of the multi-purpose tool watch 1 to store its tool members 50 in a compact configuration is what sets this invention apart from the prior art. The compact nature of this invention provides for a conventional and easily functional tool set to be carried on an individual's person via the wristband housing 2. The above-referenced figures demonstrate one embodiment where the tool members 50 are configured in a substantially curved shape in order to be in the tool watch area. One possible embodiment features the tool members 50 in a curved position to wrap around the inside of the tool kit 203050. It should be appreciated that the substantially curved nature of the tool members 50 is one possible embodiment and other shapes may be utilized for tool members 50 to fit inside the area or be attached on the tool kit 203050. The tool member 50 configurations further adapted to allow the stored positions of each of said tool members 50 to be located proximate said tubular member 20 outer surface 22 and beneath said flange 30 bottom surface 32 in a manner so as to allow said tubular member 20 with said plurality of tool members 50 in said stored positions to be located and stored completely within the boundaries of said cavity 42. In one embodiment, the tool members 50, when stored are positioned to be located in area between said tubular member 20 outer surface 22 and said sidewall 6 of the wristband housing 2 when said watch body 10 bottom body surface 13 is adjacent said wristband housing 2 bottom surface 3.

Figure 5:
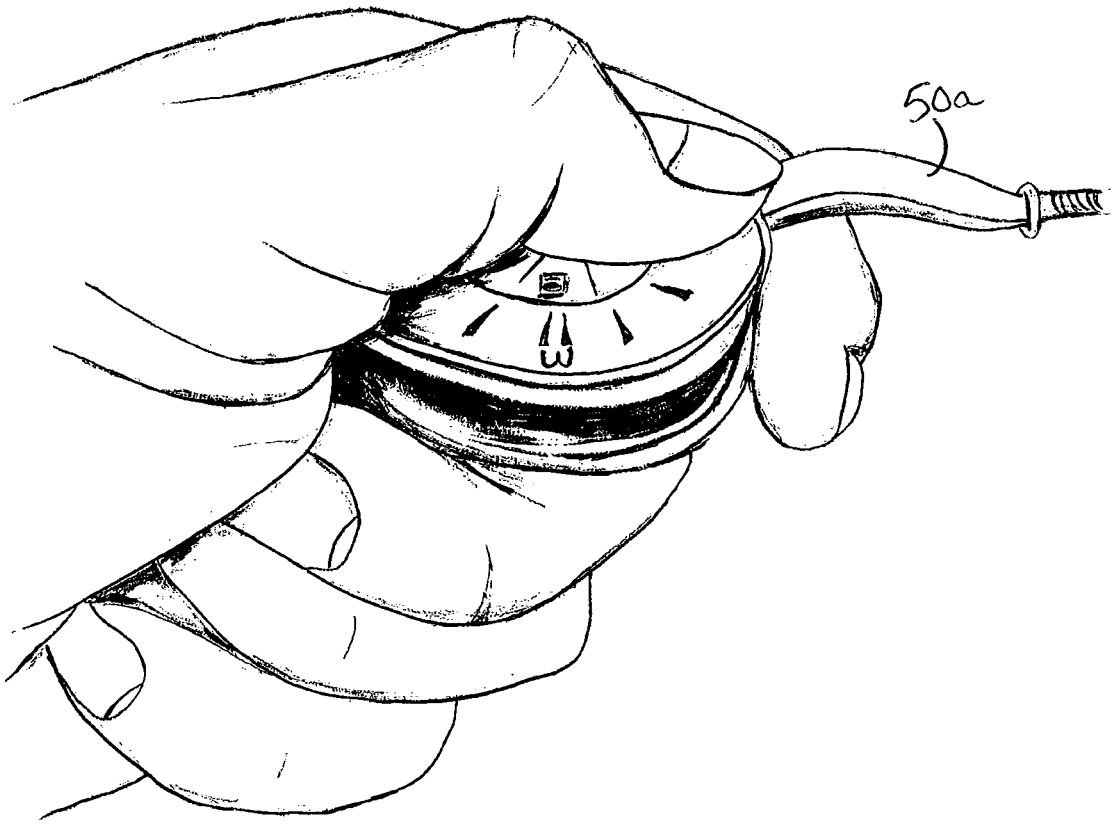
FIG. 5 is a perspective, elevational view that illustrates a preferred embodiment of the present invention, the multi-purpose tool kit being shown apart from the wrist of an individual and the individual having removed the watch body, tubular member, flange, and tools from the wristband housing and a tool member, a flat heard screwdriver extended for use and being used by the individual.
Figure 6:
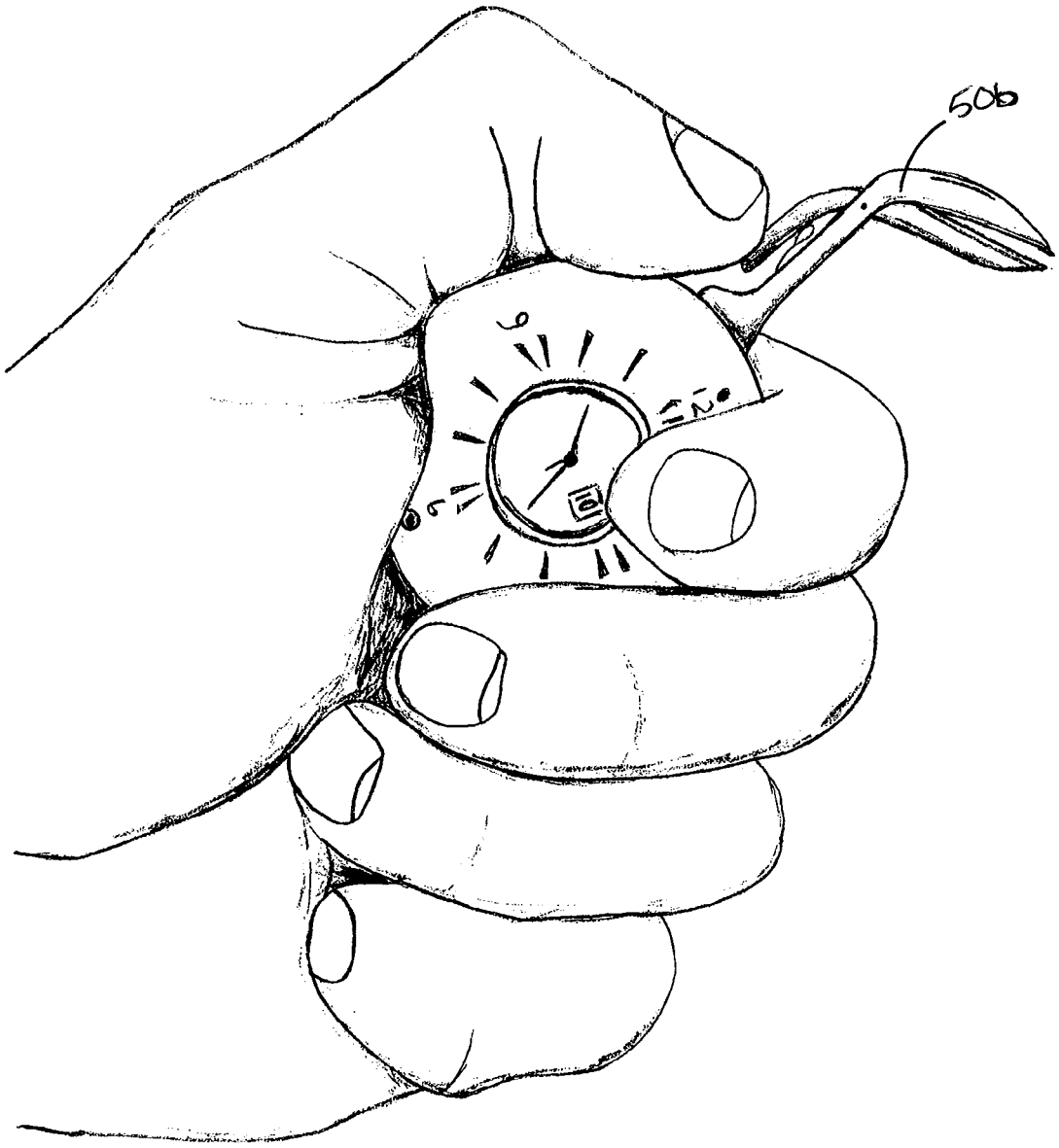
FIG. 6 is a perspective, elevational view that illustrates a preferred embodiment of the present invention, the multi-purpose tool kit being shown apart from the wrist of an individual and the individual having removed the tool kit, including the watch body, tubular member, flange, and tools from the wristband housing and another tool member, scissors, extended for use and being used by the individual.
Figure 7:
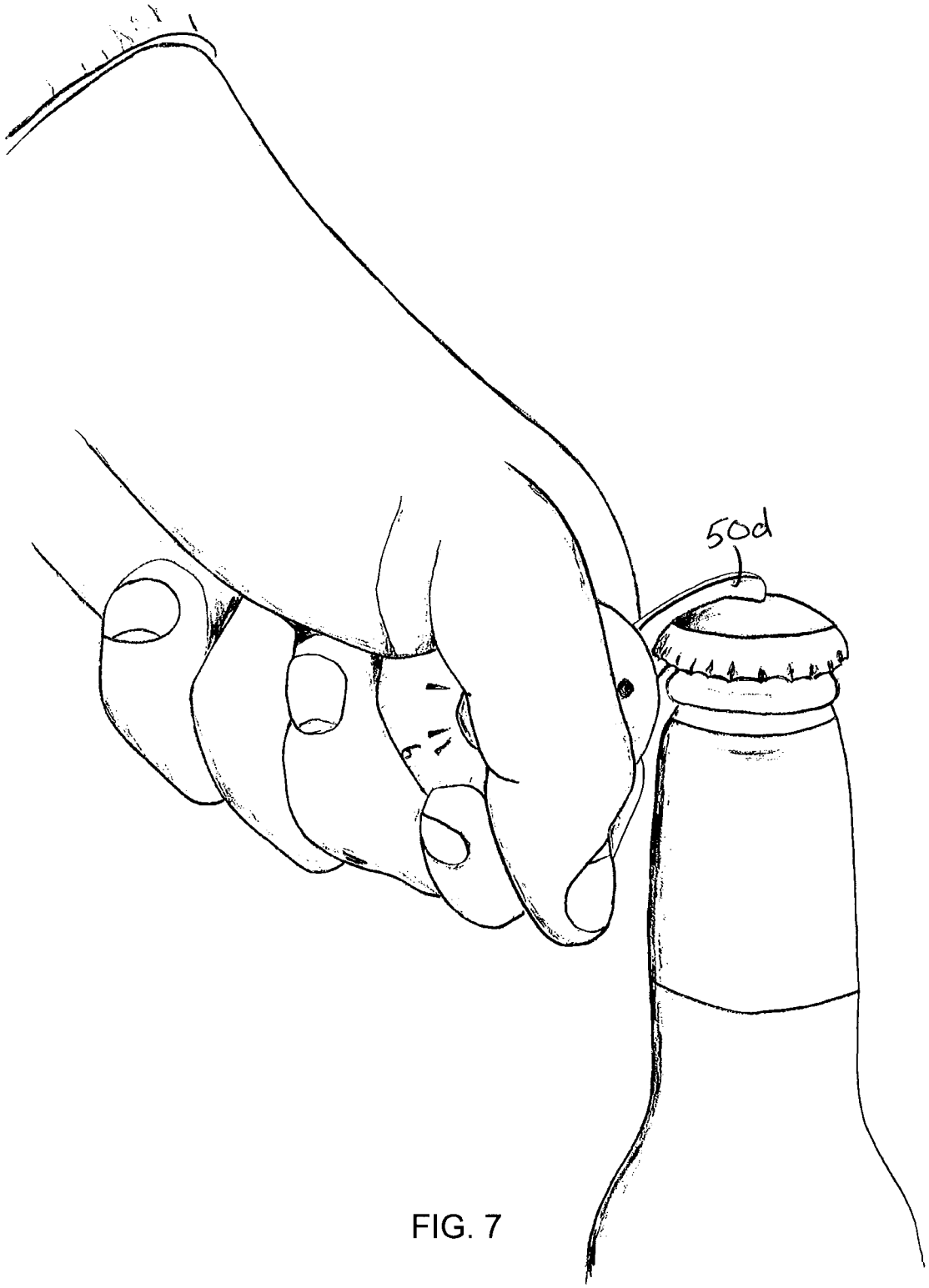
FIG. 7 is a perspective, elevational view that illustrates a preferred embodiment of the present invention, the multi-purpose tool kit being shown apart from the wrist of an individual and the individual having removed the tool kit, including the watch body, tubular member, flange, and tools from the wristband housing and yet another tool member, a bottle opener, extended for use and being used by the individual.

FIGS. 5-7 show the individual using the multi-purpose tool watch tool kit 203050 with a tool member 50 having been moved from a stored position in the donut-shaped area 42 to an extended position for use. Each tool member 50 functions with respect to its particular intended purpose. As noted earlier, in one possible embodiment of the present invention, when a tool member is extended for use, a tool stop 80 limits the extension of the tool member 50 and dictates when the position is fully reached. See FIGS. 16-19A.

Figure 9A:
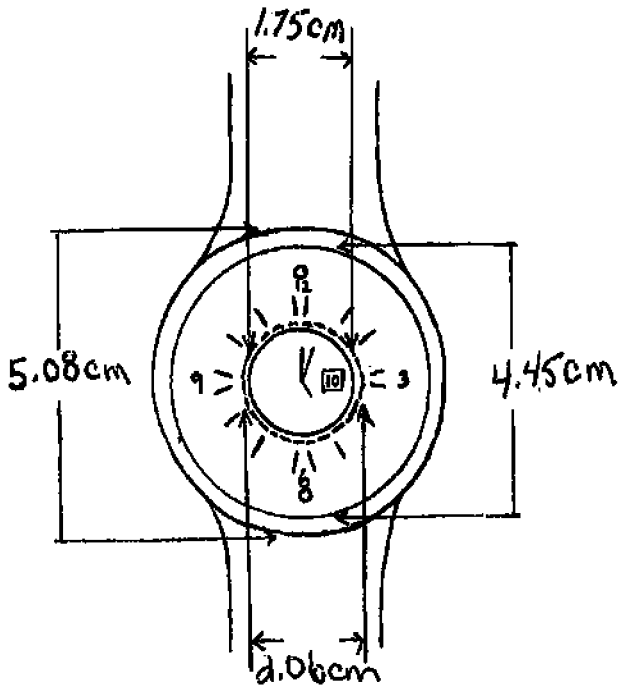
FIG. 9A is a perspective, top view of one preferred embodiment of the present invention with detailed dimensions, the multi-purpose tool watch being shown apart from the wrist of an individual.
Figure 9B:
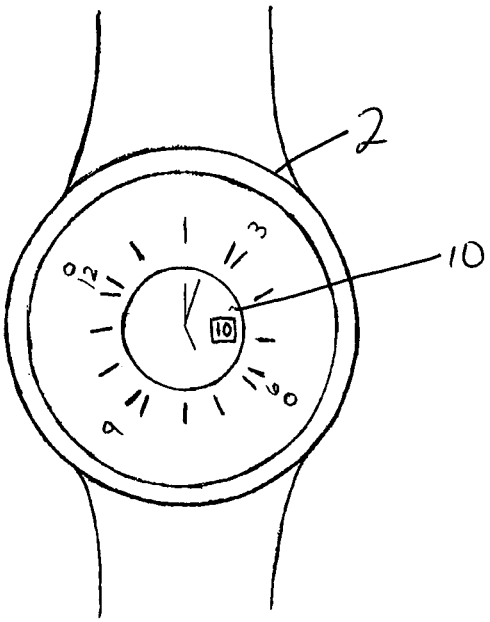
FIG. 9B is a perspective, top view of one embodiment of the present invention having time identification numerals and markings, the multi-purpose tool watch being shown apart from the wrist of an individual.
Figure 10:
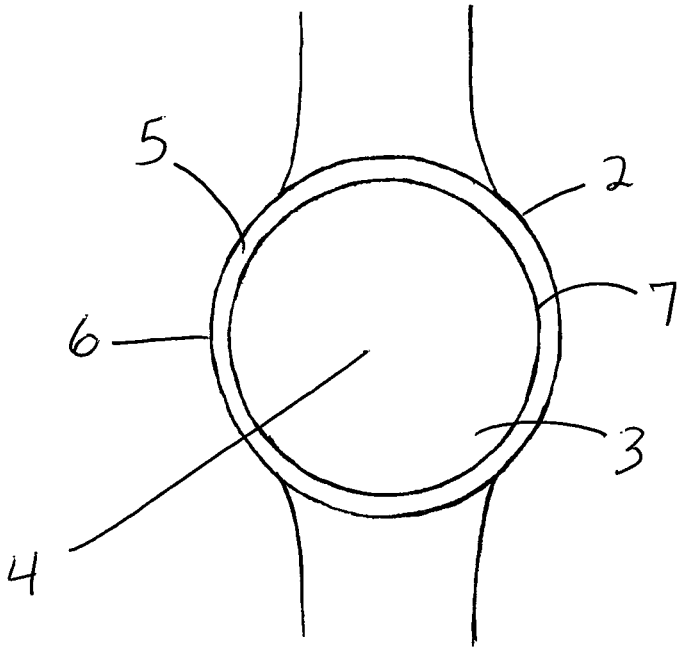
FIG. 10 is a perspective, top view of the wristband housing of the preferred embodiment of the present invention, being shown apart from the wrist of an individual.
Figure 11:
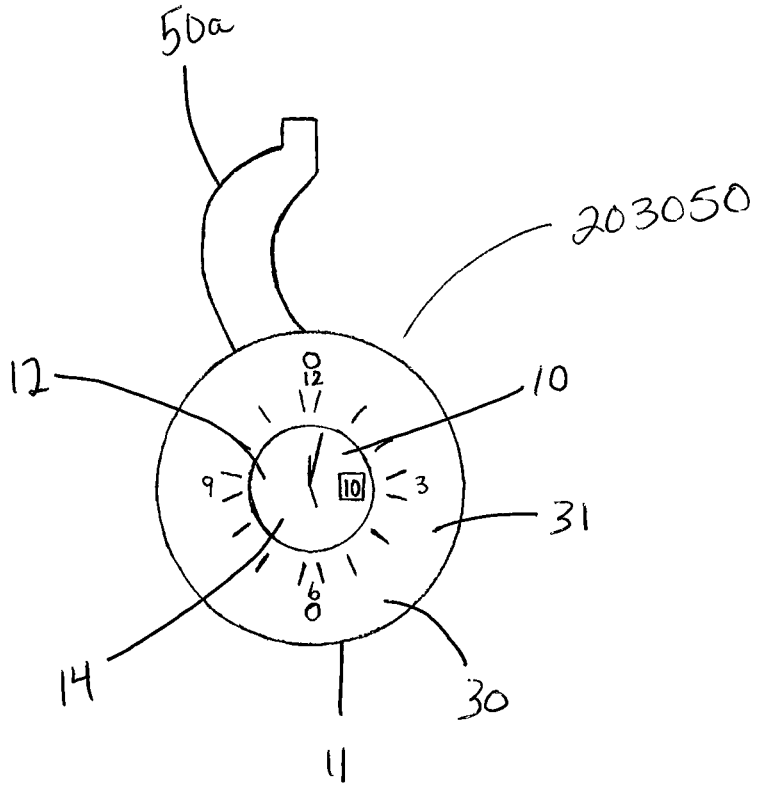
FIG. 11 is a perspective, top view of a preferred embodiment of the present invention, the multi-purpose tool kit being shown apart from the wristband housing and with a selected tool, a flat head screwdriver, in the extended position for use by the individual.
Figure 12:
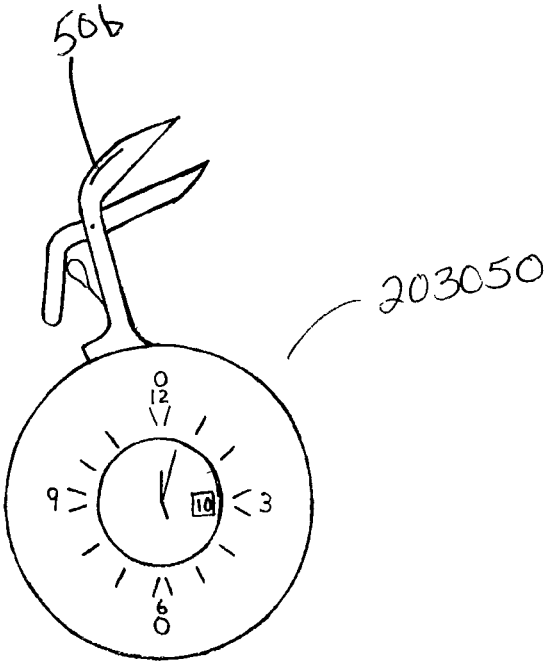
FIG. 12 is a perspective, top view of a preferred embodiment of the present invention, the multi-purpose tool kit being shown apart from the wristband housing and with a selected tool, scissors, in the extended position for use by the individual.
Figure 13:
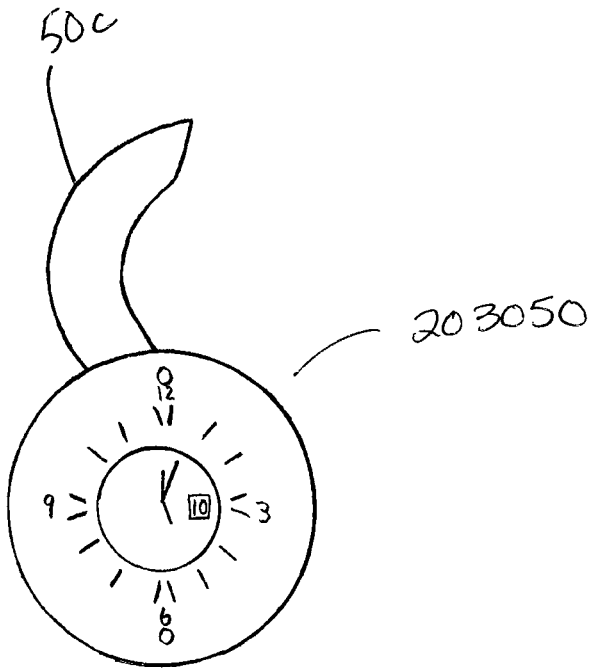
FIG. 13 is a perspective, top view of a preferred embodiment of the present invention, the multi-purpose tool kit being shown apart from the wristband housing and with a selected tool, a knife, in the extended position for use by the individual.
Figure 13A:
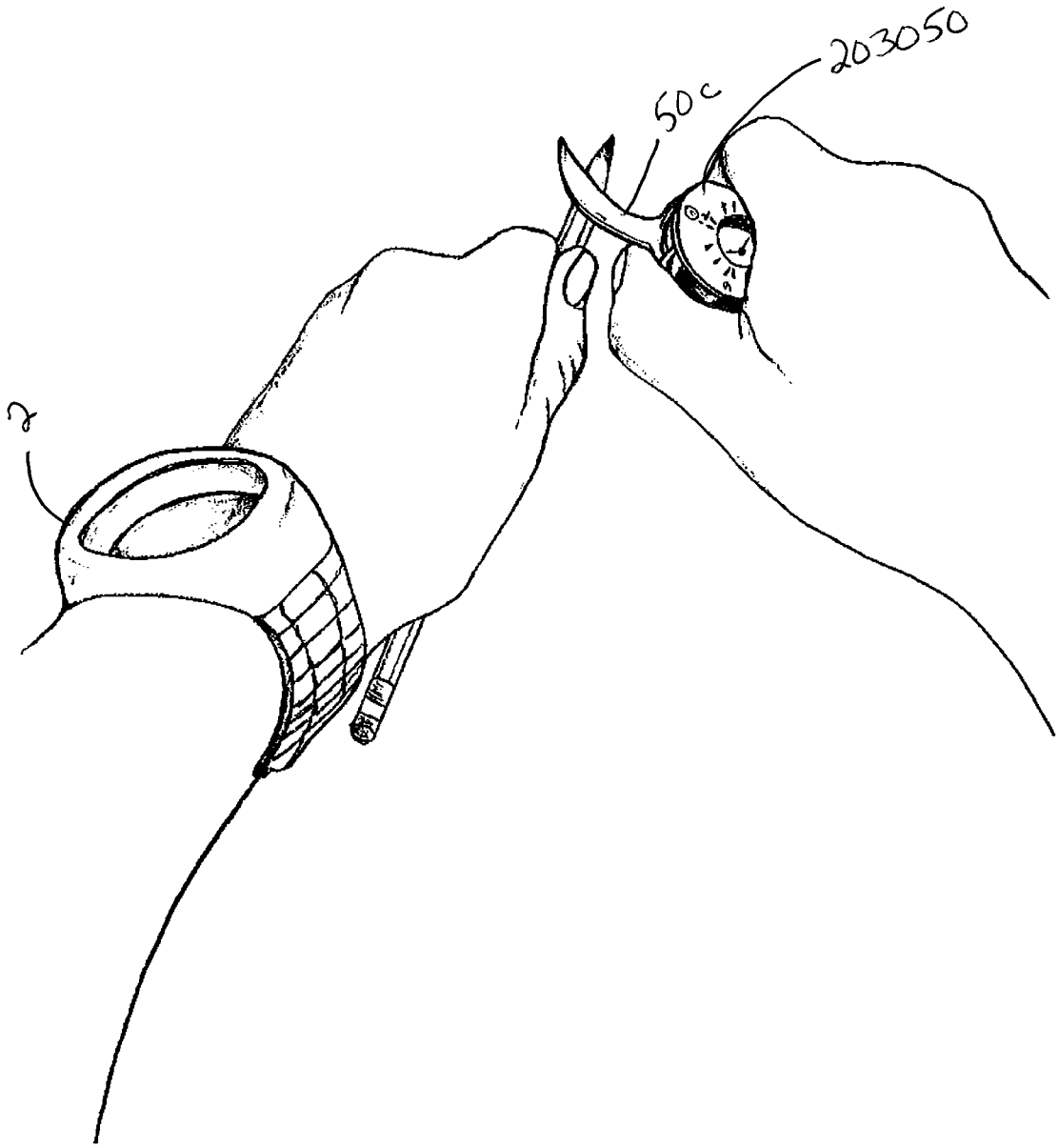
FIG. 13A is a perspective, elevational view that illustrates another possible embodiment of the present invention, the multi-purpose tool kit being shown apart from the wrist of an individual with a tool member, a knife, extended for use and being used by the individual, while the wristband housing remains on the wrist of the individual.
Figure 14:
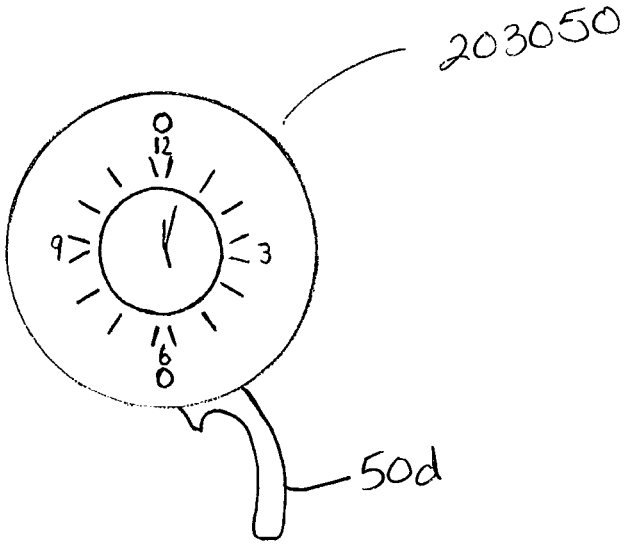
FIG. 14 is a perspective, top view of a preferred embodiment of the present invention, the multi-purpose tool kit being shown apart from the wristband housing and with a selected tool, a bottle opener, in the extended position for use by the individual.
Figure 14A:
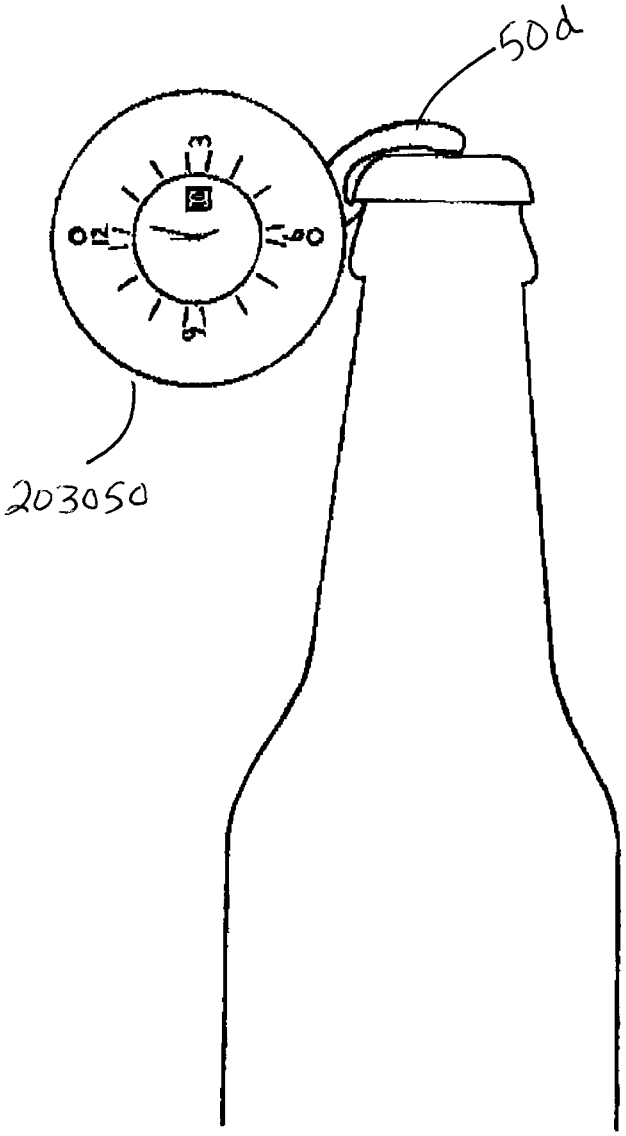
FIG. 14A is a perspective, side view of a preferred embodiment of the present invention, the multi-purpose tool kit being shown apart from the wristband housing and with a bottle opener tool member in the extended position for use on the cap of a bottle.
Figure 15:
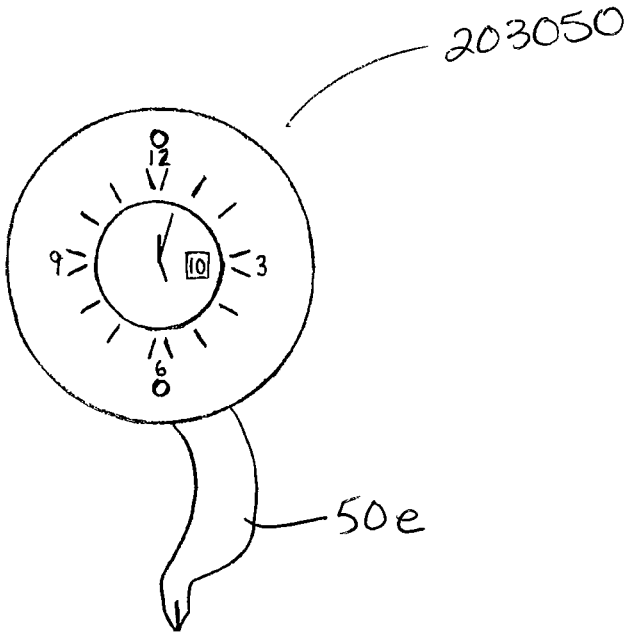
FIG. 15 is a perspective, top view of a preferred embodiment of the present invention, the multi-purpose tool kit being shown apart from the wristband housing and with a selected tool, a Phillips screwdriver, in the extended position for use by the individual.
Figure 16:
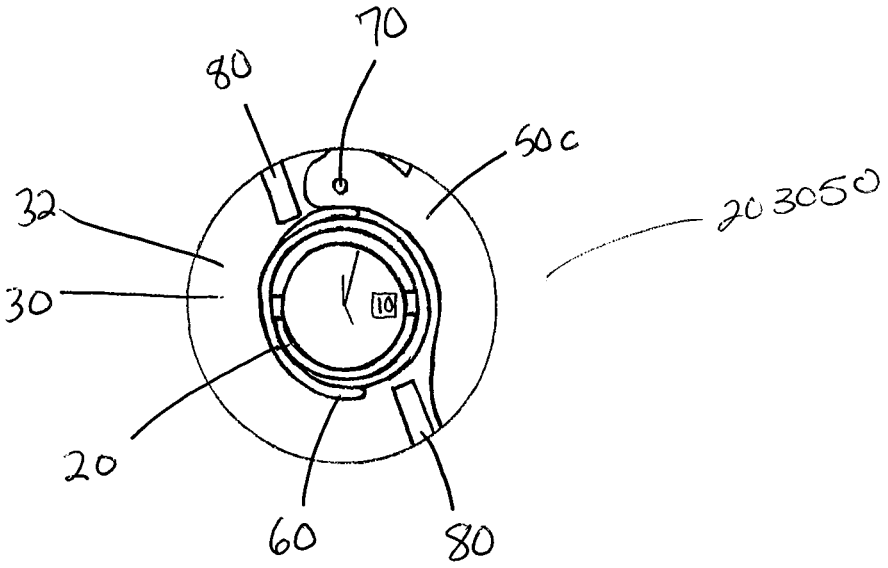
FIG. 16 is a perspective, internal top view of a preferred embodiment of the present invention, the multi-purpose tool kit, including the watch body, tubular member, flange, tool stops, posts, springs, and a tool member, a knife, being shown apart from the wristband housing and with tool members in the stored position.
Figure 17:
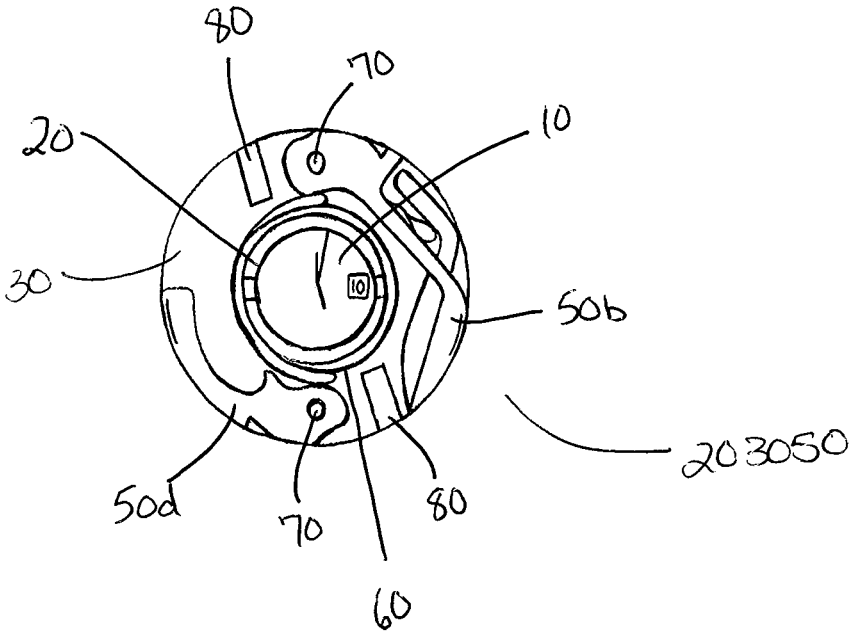
FIG. 17 is a perspective, internal top view of a preferred embodiment of the present invention, the multi-purpose tool kit, including the watch body, tubular member, flange, tool stops, posts, springs, and tool members being shown apart from the wristband housing and with tool members, scissors and a bottle opener, in the stored position.
Figure 18:
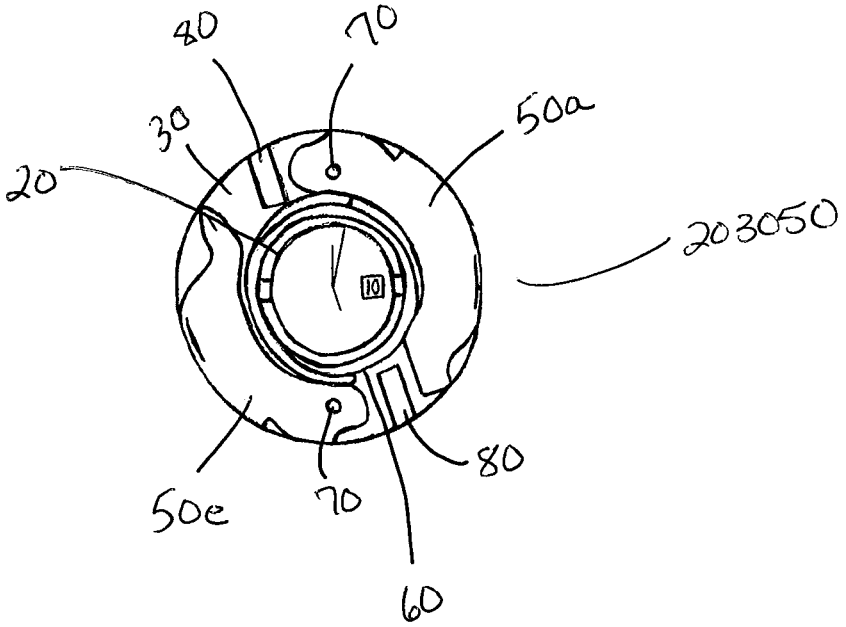
FIG. 18 is a perspective, internal top view of a preferred embodiment of the present invention, the multi-purpose tool kit, including the watch body, tubular member, flange, tool stops, posts, springs, and tool members being shown apart from the wristband housing and with tool members, a flat head screwdriver and Phillips screwdriver, in the stored position.
Figure 19:
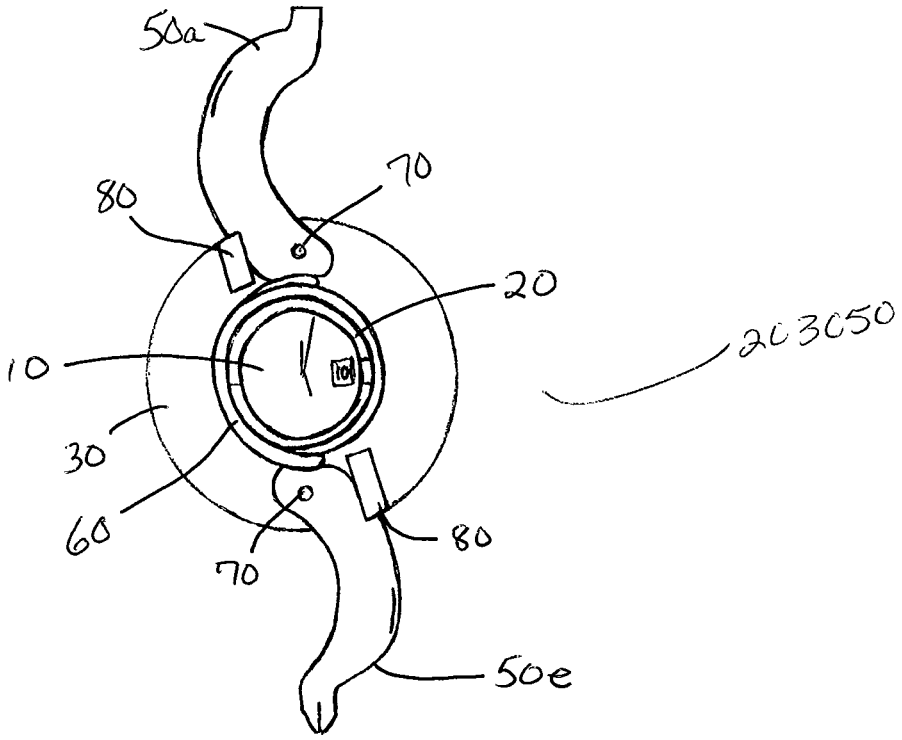
FIG. 19 is a perspective, internal top view of a preferred embodiment of the present invention, the multi-purpose tool kit, including the watch body, tubular member, flange, tools stops, posts, springs, and tool members being shown apart from the wristband housing and with selected tool members, a flat head screwdriver and Phillips screwdriver, in the extended position.
Figure 19A:
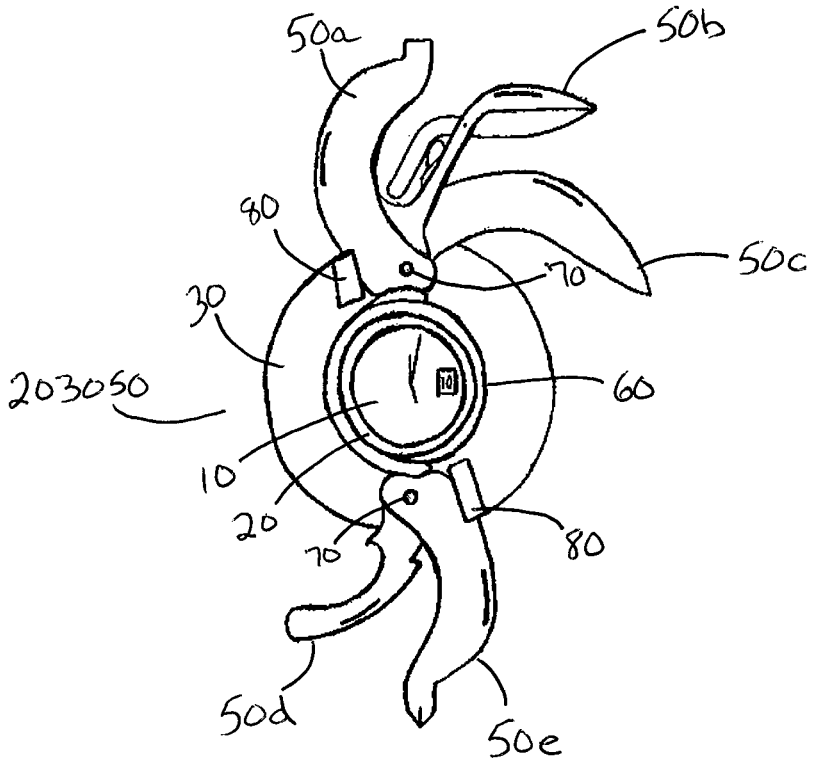
FIG. 19A is a perspective, internal top view of a preferred embodiment of the present invention, the multi-purpose tool kit, including the watch body, tubular member, flange, tool stops, posts, springs, and tool members being shown apart from the wristband housing and with the tool members, a flat head screwdriver, scissors, a knife, a Phillips head screwdriver, and a bottle opener, in the extended, or partially extended position.
Figure 20A:
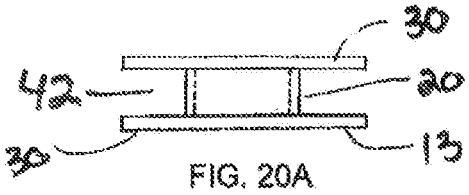
FIG. 20A is a perspective, internal side view of a preferred embodiment of the present invention, the multi-purpose tool kit, flange and tubular member.
Figure 20B:
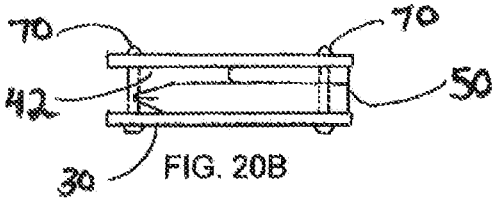
FIG. 20B is a perspective, internal side view of a preferred embodiment of the present invention, the multi-purpose tool kit, flange, tool members, and posts being shown apart from the wristband housing and with tool members, bottle opener and Phillips screwdriver, in the stored position.
Figure 20C:
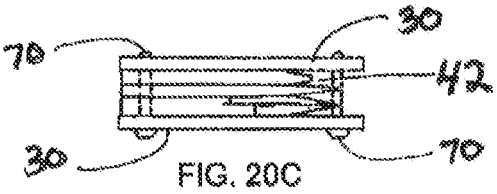
FIG. 20C is a perspective, internal side view of a preferred embodiment of the present invention, the multi-purpose tool kit, flange, tool members, and posts being shown apart from the wristband housing and with tool members, flat head screwdriver, knife, and scissors, in the stored position.
Figure 20D:
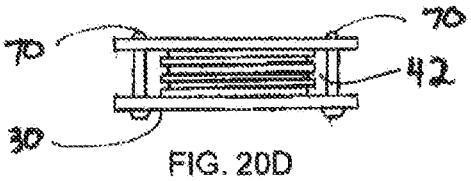
FIG. 20D is a perspective, internal side view of a preferred embodiment of the present invention, the multi-purpose tool kit, flange, tubular member, springs configured to wrap around the outer surface of the tubular member, and posts being shown apart from the wristband housing.
Figure 20E:
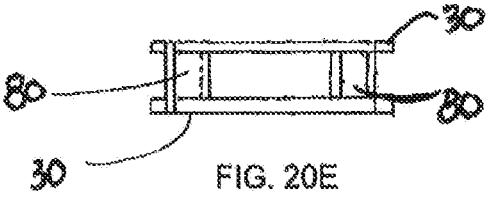
FIG. 20E is a perspective, side view of a preferred embodiment of the present invention, the multi-purpose tool kit, flange, and stops being shown apart from the wristband housing.

FIGS. 9A and 9B details the dimensions of one embodiment of the present invention having a circular face and cylindrical body. The figure shows the top view of the multi-purpose tool watch 1. In this particular embodiment, the diameter of the outer edge wall 5 of the wristband housing 2 is approximately 5.08 centimeters (cm) and the inner surface 7 diameter is approximately 4.45 cm. The diameter of the outer surface 22 of the tubular member 20 is approximately 2.06 cm and the diameter of the tubular member 20 inner surface 21 is approximately 1.75 cm. FIG. 10 further shows the wristband housing 2 separate from the tool kit 203050. The wristband housing 2 features a bottom surface 3, sidewall 6, sidewall inner surface 7, and sidewall outer edge 5. In one embodiment, the wristband housing 2 features a center point of the bottom surface 4.

As shown in FIGS. 4A-7, and 11, 12, 13, 13A, 14, 14A, and 15, one embodiment of the multi-purpose tool watch is shown where the tool kit 203050 comprises a flat head screw driver 50*a*, a knife 50*c*, scissors 50*b*, a Phillips-head screwdriver 50*e*, and a bottle opener 50*d*. Possible embodiments of the multi-purpose tool watch 1 include one tool member 50 or any combination of tool members 50. By way of example, the tool members 50 may be made of any suitable material such as metal, steel, aluminum, wood, plastic, polymer, molded material, or any like material in order to achieve the purpose of this invention. It should be understood that other materials could be used without departing from the scope of the present invention. Further, it should be appreciated by those skilled in the art that a variety of tools may be implemented in the present invention and that the tool members 50 identified herein are a representative sample of the available embodiment combinations. Other embodiments and tool members 50 not listed herein but that fall within the scope of the invention, should be interpreted to be included with this invention and the purpose this invention seeks to achieve.

FIGS. 16-19A show top, internal views of the multi-purpose tool watch 1 and particularly the tool kit 203050, in which can be seen a selected tool member 50 extended and positioned for use, with the remaining unselected tool members 50 in their stored positions. These figures also demonstrate one embodiment of the present invention that comprises a plurality of springs 60, each of which has a configuration adapted to allow the spring 60 to wrap around the outer surface 22 of the tubular member 20. See also FIG. 8F. The springs 60 provide a resistive force that must be overcome by the respective tool member 50 by way of the individual applying force and moving one or more of the tool members 50 in one embodiment from a stored position in the area 40 to an extended position, and vice versa. Thus, in one embodiment, an individual may extend the tool member 50 from the donut-shaped area 42 of the tool kit 203050 and position the tool member 50 for use. See also FIGS. 11-15, 19, and 19A. Another embodiment features a spring 60 having a top end and a bottom end so as to provide a resistive force 60 to the tool members 50. In one possible embodiment, the tool member 50 will be positioned and extended fully for use via a tool stop 80 providing a surface to come into contact with the tool member 50 and limit the extension of the tool member 50 and prevent the unintentional rotation of the tool members 50. Therefore, the tool stop 80 prevents the unintentional further rotation of a tool member 50 and stops the tool member 50 when it is positioned for use. See FIGS. 19-19A. In one embodiment, the springs 60 are substantially circular in shape; however, a variety of spring shapes may be utilized so long as they achieve the purpose of allowing the tool members to be in a stored position and extended for use. In one possible embodiment, the springs 60 is a singular spring and in another embodiment the springs 60 feature a plurality of springs 60. The multi-purpose tool watch 1 also has means for maintaining tool members 50 positioned in the extended position for use. One embodiment features the springs 60 and tool stop 80. See FIGS. 19 and 19A. In addition, other elements besides springs may also be used and incorporated into other embodiments of this invention and will be interpreted to fall within the scope of this invention. Thus, the present invention provides a useful, workable, inconspicuous, compact, and convenient way to carry a multi-purpose tool kit in everyday and outdoor activities in the same fashion of a traditional wristwatch but without the cumbersome nature of having to separately carry a bulky multi-purpose tool.

FIGS. 16-20A-E depict a plurality of pivot mounting posts 70, attached to one of the flanges 30, and has a configuration adapted to allow one of the tool members 50 to be pivotally mounted so as to rotate in a plane substantially parallel to one of the flanges 30 when moving from a stored position to an extended position for use, and vice-versa. The individual is able to carry a compact tool kit 203050 having multiple tools 50 that are stored in a safe, convenient, and easy to use fashion so as to alleviate the bulky and cumbersome traditional tool kit. In one embodiment, the pivot posts 70 may be utilized to allow tool members 50 to swivel inward to be placed in a stored position in the area, and to swivel outward to allow tool members 50 to be extended and positioned for use. The individual may select a particular tool member 50 for use by removing it from the stored position. In one embodiment, the individual provides a force to release the tool member 50 from its stored position. This pivot-post 70 allows certain tool members 50 to be stored in a compact configuration so as to provide a compact and convenient tool kit to the user to wear on his person as a conventional wristwatch. The pivot post 70 may be a singular pivot post 70 or a plurality of posts 70. The term is interchangeable and refers to both embodiments, as it is not meant to be limiting.

Another possible embodiment of the present invention comprises a plurality of tool stops 80. See FIGS. 16-19, and 19A. The tool stops 80 provide a surface such that when a tool member 50 is extended from a stored position to an open position, the tool stop 80 limits the extension of the tool member 50 and dictates when the open position is fully reached. The tool stop 80 seeks to prevent over extension of a tool member 50, and restricts the unintentional rotation of a tool member 50, and thus provides a tool member 50 stopping function.

Still further, the present invention 1 may also be utilized as a stand-alone tool kit 203050, separate and apart from the wristband housing 2. See FIGS. 4-7, 11-15. For example, the individual user may choose to not carry the tool kit 203050 on the wristband housing 2. Instead, the individual user may carry only the toolkit 203050 if so desired. This type of stand-alone usage is often dependent on the preference and needs of the individual user.

There are many suitable materials from which the present invention can be fabricated and all are considered to come within the scope of the present invention. A major consideration in the selection of such a material is the requirement that it be able to sufficiently house a plurality of tool members 50 in a convenient, easy and compact storage body that may be worn on an individual's person.

For example, many types of materials such as stainless steel, aluminum, anodized aluminum, other metal materials, polymer material, plastic, rubber, molded material, wood, or the like material have been found to be suitable from which to fabricate the construction of the present invention 1. It should be appreciated by those skilled in the art that any similar material may also be used to fabricate this multi-purpose tool watch 1.

A major consideration of the present invention is in the configuration of tool members 50 such that each tool member 50 could be located inside the tool housing area 42. In particular, experimentation was needed and conducted in connection with each tool member 50 in order to determine its substantial configuration and placement of the tool members 50 within the tool kit 203050 to fulfill the scope of the present invention. In one embodiment, the compact nature of the present invention and substantial placement of the tool members 50 in the area of the present invention is one of the many distinguishing characteristics when compared to the prior art. It is particular to note that the bottle opener 50 required even further experimentation. It was further found that in particular sizing of the bottle opener tool member 50 was needed in order to be sufficient for its intended function. In one preferred embodiment, the bottle opener tool member 50 was constructed having a substantially curved arc configuration such that the curve of the arc was sized to fit in the donut-shaped area 42 while also having enough length to fit the bottle top and to be close enough to the bottle neck to provide the force needed to open the vessel. Another embodiment utilizes a bottle opener having a substantially circular configuration that may fall within a substantially horizontal plane in alignment with the present invention 1.

Other embodiments may also be configured to fall within the scope of the present invention 1. The fabrication materials and configurations yield multi-purpose tool watch 1 that are easily and continuously used and will provide convenient and compact storage of the apparatus on the individual's person.

In one preferred embodiment, the multi-purpose tool watch 1 is fabricated such that it includes: a wristband housing 2 having a front that includes a bottom surface 3, an outer edge 5 and a sidewall 6 that extends upwards from the bottom surface 3 outer edge, and the sidewall having an inner surface 7, wherein said bottom surface 3 and sidewall inner surface 7 define the boundaries of a cavity 40 on said front of the wristband housing 2, a watch body 10 having a body boundary edge 11 and top 12 and bottom 13 body surfaces, a means 18 for aiding said wearer in a routine activity of said wearer and that is attached to said body 10, a tubular member 20 having inner 21 and outer 22 surfaces, and top 23 and bottom 24 ends, a flange 30, which extends radially outward from an end of the tubular member 20, the flange 30 having a top 31 and bottom 32 flange surface and a flange outer edge 33, wherein the tubular member 20 inner surface 21 having a configuration adapted to allow the tubular member 20 inner surface 21 to be mounted proximate to the watch body 10 boundary edge 11, wherein the flange 30 having a configuration adapted to allow the flange 30 outer edge 33 to interact with the sidewall inner surface 7 of the wristband housing 2 so as to intermittently lock and unlock the tubular member 20 and flange 30 to the wristband housing 2 when an end 23, 24 of the tubular member 20 is adjacent the wristband housing 2 bottom surface 3, a plurality of tool members 50, each having a configuration that is adapted to allow the tool member 50 to be moved from a stored to an extended position for use, and wherein the tool member 50 configurations further adapted to allow the stored positions of each of the tool members 50 to be located proximate said tubular member 20 outer surface and beneath said flange 30 bottom surface in a manner so as to allow said tubular member 20 with said plurality of tool members 50 in said stored positions to be located and stored completely within the boundaries of said cavity 42.

In another embodiment, the invention comprises a body 10 with the top 12 or bottom body surface 13 having a watch face 14 configured to visually communicate at any instant the time of day, and with the bottom surface body 13 having a center point 15.

In another preferred embodiment, the shape of the multi-purpose tool watch 1 was constructed in a substantially circular shaped fashion. Yet other embodiments feature a substantially rectangular shaped or substantially oval shaped watch 1. Other embodiments feature a tool kit 203050 of substantially circular, rectangular, and oval shaped configurations. See FIGS. 21 and 22. It should be understood, however, that the shape of the multi-purpose tool watch 1 and the tool kit 203050 may be of many shapes, sizes, lengths, and widths without departing from the scope of the present invention.

Another preferred embodiment of the present invention 1 is a multi-purpose tool watch 1 that comprises a plurality of springs 60, each of which has a configuration adapted to allow the spring 60 to wrap around the outer surface 22 of the tubular member 20 and to provide a resistive force that must be overcome by an individual in moving one or more of said tool members 50 from a stored to an extended position and vice versa.

Yet another embodiment of the present invention 1 is a multi-purpose tool watch 1 that further comprises a plurality of pivot mounting posts 70, which is attached to a flange 30 and has a configuration adapted to allow one or more of said tool members 50 to be pivotally mounted so as to rotate in a plane substantially parallel to said flange 30 when moving from a stored to an extended position and vice versa.

In addition, another embodiment of the present invention 1 is a multi-purpose tool watch 1 that comprises a plurality of tool members 50. One embodiment is a multi-purpose tool watch 1 that comprises a plurality of tool members 50 that includes a knife 50*c* and a screwdriver 50*a*, 50*e*. Another embodiment of the present invention 1 is a multi-purpose tool watch 1 that comprises a plurality of tool members 50 that includes a flat-head screwdriver 50*a*, a pair of scissors 50*b*, a bottle opener 50*d*, and a Phillips-head screwdriver 50*e*. In addition, another embodiment of the present invention 1 includes a multi-purpose tool watch 1 that comprises a plurality of tool members 50. As described earlier, these tool members 50 are listed by way of example, and should not be construed to be limiting to the construction of the present invention 1. Any combination of tool members 50*a-e* may be combined to form the tool kit 203050. Additional tool members 50 not listed herein but within the scope of this invention may also be included. Moreover, while the figures herein represent one possible embodiment of the order and positioning of the specific tool members 50*a-e*, the tool members 50 may be ordered and positioned in a variety of combinations, including those not pictured herein.

A preferred embodiment of the present invention is a multi-purpose tool watch 1 that further comprises means for preventing unintentional rotation of said plurality of tools 50. Another embodiment is a multi-purpose tool watch 1 that further comprises means for maintaining tool members 50 positioned in said extended position for use.

Figure 21:
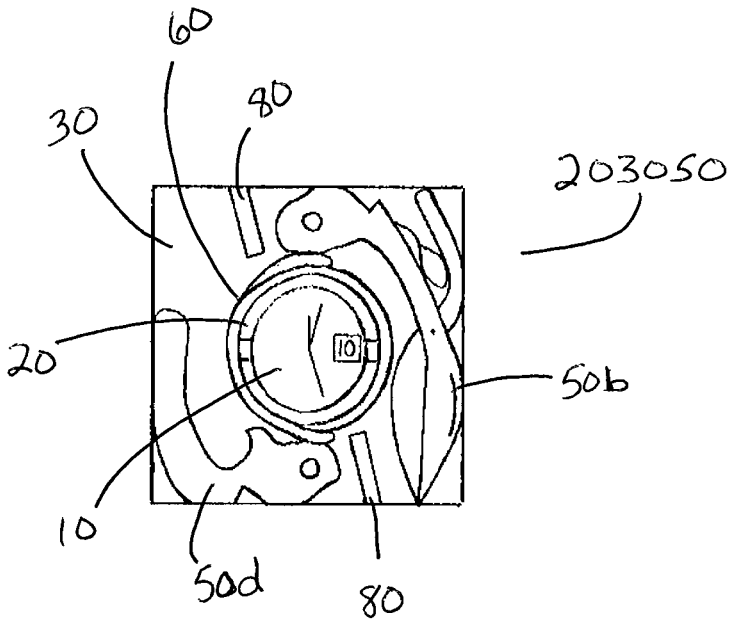
FIG. 21 is a perspective, elevational view that illustrates another possible embodiment of the present invention, the multi-purpose tool kit being shown apart from the wrist of an individual.
Figure 22:
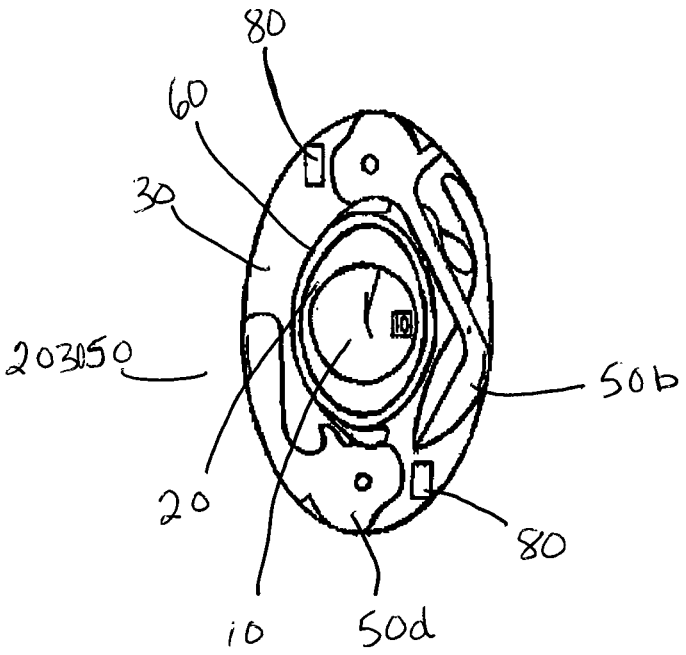
FIG. 22 is a perspective, elevational view that illustrates another possible embodiment of the present invention, the multi-purpose tool kit being shown apart from the wrist of an individual.
Figure 23:
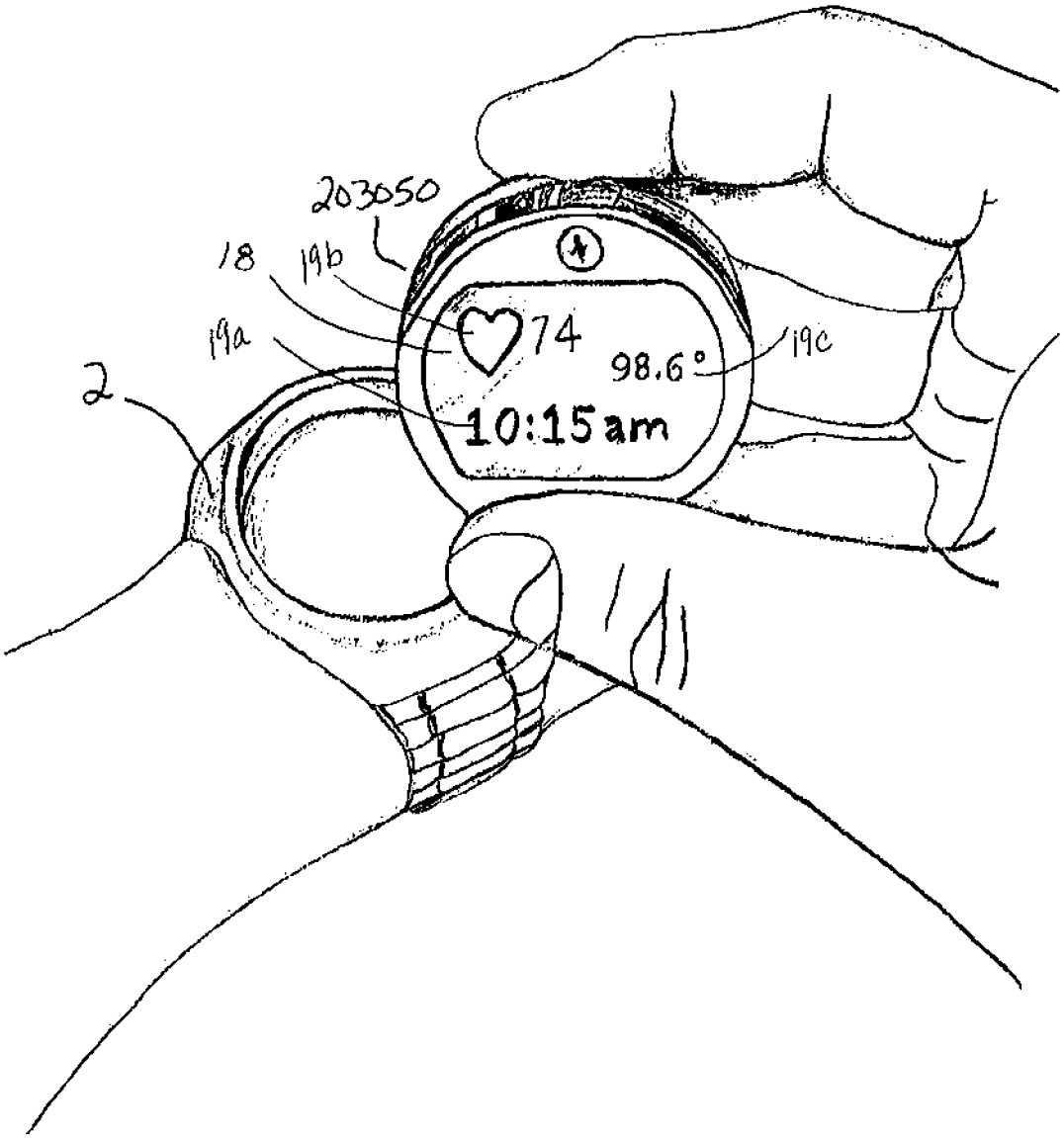
FIG. 23 is a perspective, elevational view that illustrates another possible embodiment of the present invention, the multi-purpose tool kit being shown apart from the wrist of an individual and a digital fit-type watch face extending the full surface of the top flange. The device also features a means for aiding said wearer in a routine activity of said wearer. In this embodiment, by way of one example, the device displays a sleep/health/medical monitor (including but not limited to heart rate, body temperature).
Figure 24:
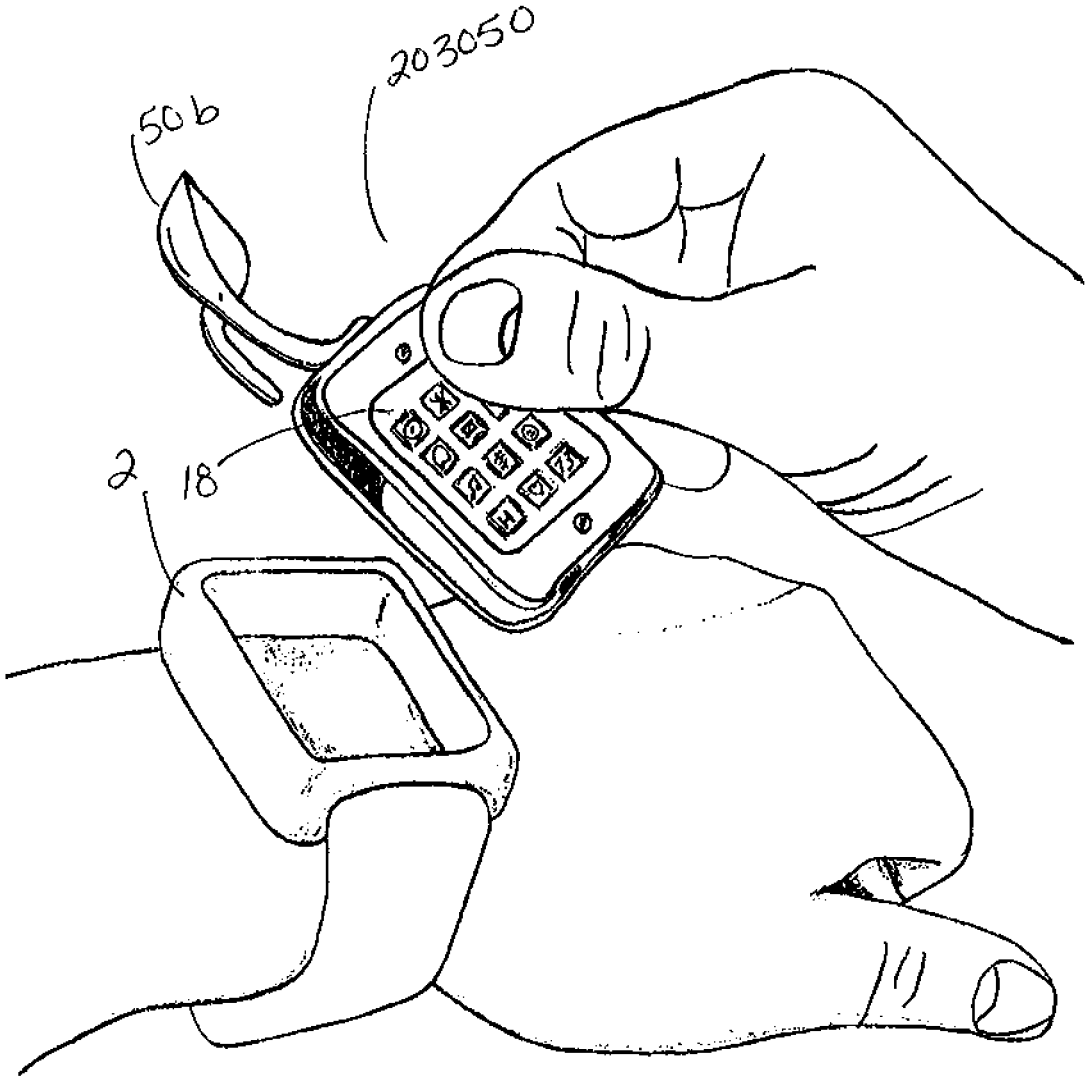
FIG. 24 is a perspective, elevational view that illustrates another possible embodiment of the present invention, the multi-purpose tool kit being shown apart from the wrist of an individual and a smart face extending the full surface of the top flange with a tool member extended for use. The device also features a means for aiding said wearer in a routine activity of said wearer. In this embodiment, by way of one example, the device displays a smart watch (and/or an available routine activity featured or available on a smart watch), sleep/health/medical monitor (including but not limited to heart rate, body temperature), music, weather, data storage, internet/cloud/TV/radio connectivity device, camera/video/sound/storage device, calculator, phone/communication/email/texting/social media, mapping/Global Positioning System (GPS)/compass, flashlight, alarm/notification/alert device, date/calendar device, gaming device, language translation device, thermometer.

In addition, FIGS. 1-4 show other embodiments of the present invention and detail the present invention having a substantially circular shape, while FIGS. 21 and 24 show the invention as having a substantially rectangular or square shape. Likewise, FIG. 22 shows one embodiment of the present invention as having a substantially oval shape. Still further, another possible embodiment is depicted in FIG. 23, showing the invention as having a digital watch display face, or incorporated as part of a fit-type of watch. The device also features a means 18 for aiding said wearer in a routine activity of said wearer. This embodiment, by way of example, displays time 19*a*, and a sleep/health/medical monitor (including but not limited to heart rate 19*b*, body temperature 19*c*). Such routine activities of the wearer are explained in further detail herein. Moreover, in other possible embodiments, the watch face may extend beyond the watch body 10. In addition, time keeping markings may be placed on the top surface of the top flange 30 as seen in FIG. 1 and FIG. 23. Another embodiment features the watch body 10 positioned proximate the outer surface of the flange 30. Still yet another embodiment features the watch body 10 boundary edge extending to the flange surface or beyond. In addition, FIG. 24 also shows another possible embodiment of the present invention that may include or take the form of a smart watch. It should be understood that although the preferred invention comprises a multi-purpose tool watch 1 having a substantially circular or cylindrical shape, by way of example, this shape should not be construed as limiting. A multitude of shapes may be utilized so long as they coincide the scope of the present invention. In addition, the smart watch may display routine activities to the wearer. The device features a means 18 for aiding said wearer in a routine activity of said wearer. This embodiment, by way of example, displays a smart watch, sleep/health/medical monitor (including but not limited to heart rate 19*b*, body temperature 19*c*), music, weather, data storage, internet/cloud/TV/radio connectivity device, camera/video/sound/storage device, calculator, phone/communication/email/texting/social media, mapping/Global Positioning System (GPS)/compass, flashlight, alarm/notification/alert device, digital/analog watch/clock 19*a*, date/calendar device, gaming device, language translation device, thermometer. Examples of routine activities of the wearer are explained in further detail herein.

The present invention encompasses a wrist-worn, tool device for use by a wearer, as well as, a wrist-worn, tool and routine activity aiding device for use by a wearer. An example of the smart body is seen in FIGS. 23 and 24. In another example, the invention further comprises a central body 10 such that the watch body 10 or smart body 10 may not contain an actual watch or routine activity aiding device at all. Theses devices also feature a means 18 for aiding said wearer in a routine activity of said wearer.

The invention further comprises a watch body, smart body, or central body 10 having a body boundary edge 11 and top 12 and bottom 13 body surfaces, with a means 18 for aiding said wearer in a routine activity of said wearer and that is attached to said body 10. Such routine activities include for example: something chosen from the group including the time of day; a location of said wearer (such as a Global Positioning System); an indication of the activity level or wellness of said wearer; an audio, visual, television, radio, electronic, or similar communication means to said wearer; an audio, visual, television, radio, electronic, or similar communication means to said secondary device (such as a computer, radio, or television). In addition, by way of further example, the routine activities include: a calculator, camera/video/sound/storage device, weather device, music storage, sleep/health/medical monitor (including but not limited to heart rate 19*b*, body temperature 19*c*), data storage device, internet/cloud/TV/radio connectivity device, smart watch (and/or an available routine activity featured or available on a smart watch), mapping/Global Positioning System (GPS)/compass, satellite receiver, phone/communication/email/texting/social media device, flashlight, alarm/notification/alert device, fitness/exercise monitor/device, diving device, altitude device, digital/analog watch/clock 19*a*, date/calendar device, gaming device, language translation device, electronic key/entry device, vehicle start/entry device, firearm activation device, home automation device, thermometer, stopwatch, walkie-talkie set, laser pointer, computer mouse, remote garage door opener, small item storage compartment, or no device at all.

Thus, in addition to the above-referenced items, the invention may have means of including, having, featuring, displaying, or communicating similar routine activity items, or a combination of one or more routine activity items, or the body 10 may contain no routine activity aiding device at all. For lexicon purposes, the terms "include", "have", "feature", "display" or "communicate" are used interchangeably, and are meant to include similar terms.

The present invention further encompasses a method of fabricating a wrist-worn, tool and routine activity aiding device for use by a wearer, said device comprising the steps of: (a) providing a wristband housing having a front that includes a bottom surface, an outer edge and a sidewall that extends upwards from said bottom surface outer edge, said sidewall having an inner surface, and wherein said bottom surface and sidewall inner surface define the boundaries of a cavity on said front of said wristband housing, (b) providing a watch body having a boundary edge and top and bottom body surfaces, (c) providing a means for aiding said wearer in a routine activity of said wearer and that is attached to said watch body, (d) providing a tubular member having inner and outer surfaces, and top and bottom ends, (e) providing a flange, which extends radially outward from an end of said tubular member, said flange having a top and bottom flange surface and a flange outer edge, wherein said tubular member inner surface having a configuration adapted to allow said tubular member inner surface to be mounted proximate to said watch body boundary edge, wherein said flange having a configuration adapted to allow said flange outer edge to interact with said sidewall inner surface of said wristband housing so as to intermittently lock and unlock said tubular member and flange to said wristband housing when an end of said tubular member is adjacent said wristband housing bottom surface, (f) providing a plurality of tool members, each having a configuration that is adapted to allow said tool member to be moved from a stored to an extended position for use, and wherein said tool member configurations further adapted to allow the stored positions of each of said tool members to be located proximate said tubular member outer surface and beneath said flange bottom surface in a manner so as to allow said tubular member with said plurality of tool members in said stored positions to be located and stored completely within the boundaries of said cavity.

Experimentation was conducted to determine the optimal size and positioning of the watch body 10, tubular member 20, flanges 30, donut-shaped area 42, and tool members 50. These actions provided for an adequate configuration and functionality in order to create a compact and convenient multi-purpose tool watch 1 where a plurality of tool members 50 are stored and contained, in addition to also being able to be extended and positioned for use.

Advantages of the present invention 1 include the convenience of a multi-tool survival kit in a compact and aesthetically pleasing configuration that may be carried and used by an individual during the course of the individual's normal activities, outdoor excursions, or for unexpected tasks. The individual would wear the multi-purpose tool watch on the individual's person as opposed to carrying a separate tool kit that is often bulky and cumbersome and carried as a separate personal effect. The present invention provides for easy storage in terms of allowing the individual to comfortably wear the watch on the individual's wrist and conveniently access and use multiple tools upon necessity. In addition, the present invention has the advantage of housing multiple tools in an inconspicuous manner and requires minimal effort and thought for use and transportation by the individual.

Furthermore, the proposed multi-purpose tool watch is designed so as to be easily used and manufactured using conventional forms of manufacturing and conventional materials so as to provide a multi-purpose tool watch that will be economically feasible, long lasting for an item of its nature, and relatively trouble-free in operation.

The foregoing is considered as illustrative only of the principles of the present invention. Further, since numerous modifications and changes will readily occur to those skilled in the art, it is not desired to limit the invention to the exact construction, operation, and utilization shown and described herein. Accordingly, all suitable modifications and equivalents may be resorted to, falling within the scope of the invention that is illustratively set forth in the following representative claims to the present invention.

I claim:

1. A wrist-worn, tool and routine activity aiding device for use by a wearer, said device comprising:

a wristband housing having a front that includes a bottom surface, an outer edge and a sidewall that extends upwards from said outer edge, said sidewall having a solid inner surface, and wherein said bottom surface and solid inner surface define the boundaries of a cavity on said front of said wristband housing, wherein said wristband housing is adapted to encircle and be worn on the wrist of a wearer, a central body having a boundary edge and top and bottom body surfaces, and a means for aiding said wearer in a routine activity of said wearer, a tubular member having inner and outer surfaces, and top and bottom ends, a flange, which extends radially outward from an end of said tubular member, said flange having a top and bottom flange surface and a flange outer edge, wherein said tubular member inner surface having a configuration adapted to removably attach said tubular member inner surface to said central body boundary edge, wherein said flange having a configuration adapted to allow said flange outer edge to interact with said solid inner surface of said wristband housing so as to intermittently lock and unlock said tubular member and flange to said wristband housing when an end of said tubular member is adjacent said wristband housing bottom surface, a plurality of tool members, wherein each of said plurality of tool members having a configurations adapted to allow said tool member to be located proximate and lateral to said tubular member outer surface and proximate and beneath said flange bottom surface in a manner so as to allow said tubular member and said plurality of tool members to be located in a stored position completely within the boundaries of said cavity, wherein said solid inner surface further is configured to require the removal from said cavity of said central body, tubular member, flange and plurality of tool members, and the relocation of a tool member from beneath said flange bottom surface before said tool members can be used, and, when one of said plurality of tool members is so removed from said cavity and relocated from beneath said flange bottom surface, said one of said plurality of tool members is in an extended position.

2. The wrist-worn, tool and routine activity aiding device as recited in claim 1, further comprising a plurality of springs, each of which has a configuration adapted to allow said spring to wrap around the outer surface of said tubular member and to provide a resistive force that must be overcome by a multi-purpose tool watch user in moving each of said tool members from the stored to the extended position and vice versa.

3. The wrist-worn, tool and routine activity aiding device as recited in claim 1, further comprising a plurality of pivot mounting posts, each of which is attached to said flange and has a configuration adapted to allow each of said tool members to be pivotally mounted so as to rotate in a plane substantially parallel to said flange when moving from the stored to the extended position and vice versa.

4. The wrist-worn, tool and routine activity aiding device as recited in claim 2, further comprising a plurality of pivot mounting posts, each of which is attached to said flange and has a configuration adapted to allow each of said tool members to be pivotally mounted so as to rotate in a plane substantially parallel to said flange when moving from the stored to the extended position and vice versa.

5. The wrist-worn, tool and routine activity aiding device as recited in claim 1, further comprising means for preventing unintentional rotation of said plurality of tools.

6. The wrist-worn, tool and routine activity aiding device as recited in claim 2, further comprising means for preventing unintentional rotation of said plurality of tools.

7. The wrist-worn, tool and routine activity aiding device as recited in claim 3, further comprising means for preventing unintentional rotation of said plurality of tools.

8. The wrist-worn, tool and routine activity aiding device as recited in claim 4, further comprising means for preventing unintentional rotation of said plurality of tools.

9. The wrist-worn, tool and routine activity aiding device as recited in claim 1, further comprising means for maintaining tool members positioned in said extended position for use.

10. The wrist-worn, tool and routine activity aiding device as recited in claim 3, further comprising means for maintaining tool members positioned in said extended position for use.

11. A method of fabricating a wrist-worn, tool and routine activity aiding device for use by a wearer, said method comprising the steps of:

providing a wristband housing having a front that includes a bottom surface, an outer edge and a sidewall that extends upwards from said outer edge, said sidewall having a solid inner surface, and wherein said bottom surface and solid inner surface define the boundaries of a cavity on said front of said wristband housing, wherein said wristband housing is adapted to encircle and be worn on the wrist of a wearer, providing a central body having a boundary edge and top and bottom body surfaces, and a means for aiding said wearer in a routine activity of said wearer, providing a tubular member having inner and outer surfaces, and top and bottom ends, providing a flange, which extends radially outward from an end of said tubular member, said flange having a top and bottom flange surface and a flange outer edge, wherein said tubular member inner surface having a configuration adapted to removably attach said tubular member inner surface to said central body boundary edge, wherein said flange having a configuration adapted to allow said flange outer edge to interact with said solid inner surface of said wristband housing so as to intermittently lock and unlock said tubular member and flange to said wristband housing when an end of said tubular member is adjacent said wristband housing bottom surface, providing a plurality of tool members, wherein each of said plurality of tool members having a configurations adapted to allow said tool members to be located proximate and lateral to said tubular member outer surface and proximate and beneath said flange bottom surface in a manner so as to allow said tubular member and said plurality of tool members to be located in a stored position completely within the boundaries of said cavity, wherein said solid inner surface further is configured to require the removal from said cavity of said central body, tubular member, flange and plurality of tool members, and the relocation of a tool member from beneath said flange bottom surface before said tool members can be used, and, when one of said plurality of tool members is so removed from said cavity and relocated from beneath said flange bottom surface, said one of said plurality of tool members is in an extended position.

12. The method of fabricating a wrist-worn, tool and routine activity aiding device as recited in claim 11, further comprising the steps of providing a plurality of springs, each of which has a configuration adapted to allow said spring to wrap around the outer surface of said tubular member and to provide a resistive force that must be overcome by a multi-purpose tool watch user in moving each of said tool members from the stored to the extended position and vice versa.

13. The method of fabricating a wrist-worn, tool and routine activity aiding device as recited in claim 11, further comprising the steps of providing a plurality of pivot mounting posts, each of which is attached to said flange and has a configuration adapted to allow each of said tool members to be pivotally mounted so as to rotate in a plane substantially parallel to said flange when moving from the stored to the extended position and vice versa.

14. The method of fabricating a wrist-worn, tool and routine activity aiding device as recited in claim 12, further comprising the steps of providing a plurality of pivot mounting posts, each of which is attached to said flange and has a configuration adapted to allow each of said tool members to be pivotally mounted so as to rotate in a plane substantially parallel to said flange when moving from the stored to the extended position and vice versa.

15. The method of fabricating a wrist-worn, tool and routine activity aiding device as recited in claim 11, further comprising the step of providing a means for preventing unintentional rotation of said plurality of tools.

16. The method of fabricating a wrist-worn, tool and routine activity aiding device as recited in claim 12, further comprising the step of providing a means for preventing unintentional rotation of said plurality of tools.

17. The method of fabricating a wrist-worn, tool and routine activity aiding device as recited in claim 13, further comprising the step of providing a means for preventing unintentional rotation of said plurality of tools.

18. The method of fabricating a wrist-worn, tool and routine activity aiding device as recited in claim 14, further comprising the step of providing a means for preventing unintentional rotation of said plurality of tools.

19. The method of fabricating a wrist-worn, tool and routine activity aiding device as recited in claim 11, further comprising the step of providing a means for maintaining tool members positioned in said extended position for use.

20. The method of fabricating a wrist-worn, tool and routine activity aiding device as recited in claim 13, further comprising the step of providing a means for maintaining tool members positioned in said extended position for use.

* * * * *